US012421752B2

(12) United States Patent
Bogue et al.

(10) Patent No.: US 12,421,752 B2
(45) Date of Patent: Sep. 23, 2025

(54) MODULAR INFLATABLE STRUCTURES

(71) Applicant: WobbleWorks, Inc., Wilmington, DE (US)

(72) Inventors: Maxwell Bogue, Hong Kong (HK); Thomas Glick, Wilmington, DE (US)

(73) Assignee: WobbleWorks, Inc., Wilmington, DE (US)

( * ) Notice: Subject to any disclaimer, the term of this patent is extended or adjusted under 35 U.S.C. 154(b) by 0 days.

(21) Appl. No.: 18/123,241

(22) Filed: Mar. 17, 2023

(65) Prior Publication Data

US 2023/0295950 A1 Sep. 21, 2023

Related U.S. Application Data

(60) Provisional application No. 63/321,037, filed on Mar. 17, 2022.

(51) Int. Cl.
*E04H 15/20* (2006.01)
*A63H 33/10* (2006.01)

(52) U.S. Cl.
CPC ..... *E04H 15/20* (2013.01); *A63H 33/108* (2013.01); *E04H 2015/201* (2013.01); *E04H 2015/206* (2013.01)

(58) Field of Classification Search
CPC ..... E04H 15/20; E04H 2015/201; E04H 2015/206; A63H 33/008; A63H 33/107; A63H 33/108; A63G 31/12
See application file for complete search history.

(56) References Cited

U.S. PATENT DOCUMENTS 2,297,150 A * 9/1942 Hunter ..... E04H 15/20 52/2.21
2,731,768 A 1/1956 Harrowe
3,604,597 A 9/1971 Pohl et al.
(Continued)

FOREIGN PATENT DOCUMENTS

EP 3613484 A1 2/2020
GB 2439545 A * 1/2008 ..... E04H 15/20
WO WO-87/02438 A1 4/1987

OTHER PUBLICATIONS

Invitation to Pay Additional Fees and Partial International Search of Application No. PCT/US2023/015575, dated Jun. 19, 2023, 13 pages.

(Continued)

*Primary Examiner* — Phi D A
*Assistant Examiner* — Phi D Tran
(74) *Attorney, Agent, or Firm* — Nathan S. Smith; Morgan, Lewis & Bockius LLP

(57) ABSTRACT

A modular inflatable structure can be formed using inflatable members that are interconnected together at respective joints. The inflatable member can have a connector integrated therewith or be coupled to a separate connector that interconnects adjacent inflatable members. The connector can have flexible and/or rigid components. The structure can have an assembled position in which the inflatable member is coupled with an adjacent inflatable member and flow is permitted therebetween. The structure can be inflated to form a support or framework that can be used in a variety of applications and industries.

28 Claims, 14 Drawing Sheets

(56) References Cited

U.S. PATENT DOCUMENTS

| | | | | |
|---|---|---|---|---|
| 4,384,435 | A * | 5/1983 | Polise | E04H 15/20 D25/19 |
| 4,876,829 | A * | 10/1989 | Mattick | E04H 15/20 135/125 |
| 4,951,440 | A * | 8/1990 | Staeger | E04B 1/5843 403/171 |
| 5,072,553 | A * | 12/1991 | Bozetto | E04H 5/12 261/DIG. 11 |
| 5,853,774 | A | 12/1998 | Dreve | |
| 6,192,633 | B1 * | 2/2001 | Hilbert | E04H 15/20 52/87 |
| 6,460,481 | B1 | 10/2002 | Young | |
| 6,776,602 | B2 | 8/2004 | Swanson et al. | |
| 9,562,352 | B2 * | 2/2017 | Benthien | E04B 1/19 |
| 10,179,998 | B1 * | 1/2019 | Ramp | E04C 3/005 |
| 10,400,411 | B2 * | 9/2019 | Warner | E02B 15/0814 |
| 2001/0033037 | A1 | 10/2001 | Nitschke et al. | |
| 2002/0083653 | A1 * | 7/2002 | Hilbert | E04H 15/20 52/2.17 |
| 2009/0300993 | A1 * | 12/2009 | Lamke | E04H 15/20 52/2.18 |
| 2014/0209184 | A1 * | 7/2014 | Frayne | F16K 15/20 137/223 |
| 2017/0128850 | A1 | 5/2017 | Wicken et al. | |
| 2017/0144077 | A1 * | 5/2017 | Wicken | A63H 27/10 |
| 2017/0298587 | A1 * | 10/2017 | Warner | E02B 15/0864 |
| 2018/0296935 | A1 | 10/2018 | Mowbray | |
| 2019/0128011 | A1 * | 5/2019 | Derbes | E04H 15/20 |

OTHER PUBLICATIONS

International Search Report and Written Opinion of Application No. PCT/US2023/015575, dated Aug. 17, 2023, 20 pages.

Donutman.sub.--2000 "Plastic Welding Gun (Plastruder MK4)" published Sep. 19, 2010, http://www.thingiverse.com/thing:4156, last accessed Jul. 3, 2014.

* cited by examiner

MODULAR INFLATABLE STRUCTURES

CROSS-REFERENCE TO RELATED APPLICATIONS

The present application claims priority to and the benefit of U.S. Patent App. No. 63/321,037, filed on Mar. 17, 2022, the entirety of which is incorporated herein by reference.

BACKGROUND

Field

The present disclosure relates to inflatable structures and, in particular, to inflatable structures that use interchangeable connectors and inflatable members having a variety of structural and functional features.

SUMMARY

The present disclosure describes a system of components that can be combined to form a modular inflatable structure. The structure can be formed using inflatable members that are interconnected together at respective joints. The inflatable members can have a connector, which can be integrated therewith or coupled thereto as a separate connector, that interconnects adjacent inflatable members. The structure can have an assembled position in which the inflatable member is coupled with an adjacent inflatable member and flow is permitted therebetween.

In some embodiments, inflatable structures can be formed using a variety of interchangeable components, such as connectors, valves, connector arms, caps, and/or inflatable members that can be selectively coupled to each other to form the inflatable structure. The connector can be incorporated into the inflatable member itself or formed as a separate component that is interconnected with one or more inflatable members in order to form a framework that can be inflated from a collapsed or uninflated configuration to an inflated or expanded configuration. As discussed further herein, the various advantages and applications for such structures create numerous opportunities and benefits in a variety of industries.

An aspect of at least some embodiments disclosed herein is beneficial and advantageous ease of storage when the structure is in the collapsed configuration and the rapidity of expansion into the deployed configuration so that the structure is ready for use.

According to some embodiments disclosed herein, the structure can also be modular. Thus, components of the system can be connected to form or modify a shape and/or function of the structure.

The modularity of the structure can enable a variety of unique connectors, tubing, panels, bases, and/or other devices, including lighting, motors, electrical and/or plumbing components, and/or other features that may be commonly incorporated into toys, housing structures, or other service structures where aspects of the presently disclosed system may find utility. The modularity of the system can allow a user to expand the system or replace components of the system in order to construct a structure that is specifically designed for a user's particular needs.

For example, the structure can be used for portable garage spaces for vehicles, trade booths, construction sets for educational, recreational, or commercial use, portable structures such as sheds, tents, forts, storages, and garages, temporary housing that can be used during emergency situations, obstacle courses, protective shelters against inclement weather, molds for retaining or supporting certain types of construction material (e.g., to be used to hold or be filled with a material, such as concrete or other materials that can be sprayed onto the structure or otherwise supported by the structure in order to cure and facilitate the creation of a permanent structure, and other various construction and recreational applications).

Optionally, in some embodiments, there may be no valves incorporated into the inflatable members and/or the connectors themselves (e.g., a closure caps could be used to close off the inflatable member to make it).

In some embodiments, the system can comprise inflatable members and connectors that are made of a rigid and/or flexible material. For example, at least a portion of the connectors, such as the main body section thereof, can be made of a flexible, deformable material. Such embodiments can permit ports of the connector to move relative to each other to different angular orientations, thereby permitting relative movement of inflatable members coupled to the connector.

For example, at least a portion of the connector (e.g., the connector body and/or at least a portion of the connector arm or port) can comprise a flexible material that can deflect or bend as a force is exerted on inflatable members attached thereto (e.g., at the joint between the inflatable member and the connector) upon exertion of a bending stress on the inflatable member or joint.

Further, in some embodiments, at least a portion of the connector (e.g., a connector arm) can be rigid to permit a secure coupling or sealing between the connector and the inflatable member(s) coupled thereto.

In accordance with some embodiments, the connector can be incorporated into the inflatable structure itself and facilitate interconnection with at least one other connector or inflatable structure. In some embodiments, the connector can be formed as a component that is separate from the inflatable structure and can be used to interconnect with one or more inflatable structures.

Thus, when the connector is formed as a component that is separate from the inflatable structure(s) of the system, the connector be formed without a valve, but can function to interact with (e.g., open and/or close) a valve that is built into or incorporated into a coupling portion of the inflatable structure when coupled thereto.

For example, whether manually by the user or by an interaction with the inflatable member when the connector is inserted into the coupling portion of the inflatable structure, the valve can be opened to permit fluid communication between the inflatable structure and the connector. The valve can also be closed manually by the user or when the connector is removed from the inflatable member.

Alternatively or in addition, the connector can itself comprise a valve and the inflatable structure can be formed without a valve. The valve of the connector can be opened and/or closed (whether manually by the user or by an interaction with the inflatable member) when the connector is coupled to the inflatable structure, thereby permitting fluid communication between the inflatable structure and the connector.

In some embodiments, the connector can also be formed without a valve so that fluid flow through the connector is unimpeded. Such embodiments can also be used with inflatable structures that do not have valves to form a system that has unimpeded airflow through from one inflatable member through the connector and into another inflatable member.

The connector of such embodiments can be used to interconnect two or more inflatable structures and permit fluid flow therebetween.

In some embodiments, the connector can be coupled to an inflatable structure without opening a valve, thereby not permitting fluid flow between the inflatable structure and the connector. Thus, in some embodiments, a valve can be incorporated into either a connector that is formed separately from the inflatable member, into an inflatable member that comprises or is formed as a single component with the connector, or omitted from both entirely. Thus, the valve can be formed as a separate component that can be coupled to the connector and/or the inflatable member. Further, closure caps can be used to provide a seal of any port or aperture of any of the components of the structure.

Optionally, the connection between the inflation tube and the connector can implement a mechanical or structural connection, such as a variety of engagement features (protrusions and/or slots) and/or a friction fit. For example, the inflatable members and the connectors can both comprise ports or connection structures that use a rigid material, such as plastic, to create a friction fit engagement.

As discussed further herein, the various advantages and applications for such structures create numerous opportunities and benefits in a variety of industries. Further, in some embodiments, the structure can be configured to include lighting, plumbing, and/or other electrical or functional components that provide utility to a user.

Some embodiments of the system can comprise an inflatable member, such as a tube, cube, rectangular prism, or panel, that can be inflated using a liquid or gas (collectively referred to hereafter as a "fluid") in order to move from a collapsed configuration to an expanded configuration. The inflatable member can be coupled to one or more connectors and interconnected with one or more additional inflatable members.

The inflatable member can have a unique size, shape, color, rigidity, or thickness to enable the inflatable member to be used for a particular application. The inflatable member can comprise an inlet port and a tubular section or other three-dimensional form, such as any variety of geometric shapes, including, but not limited to, flat panels, spheres, cylinders, cubes, pyramids, geometric prisms, and/or other three-dimensional forms. The three-dimensional form can be inflated via flow through the inlet port so that the inflatable member deploys or moves from a collapsed configuration to an expanded configuration. Accordingly, the three-dimensional form of the inflatable member can function or appear as a variety of different structures or features of a three-dimensional inflated structure, such as a wall, support column, shade panel, roof, tabletop, brace, base, or other various structural components.

In some embodiments, the inflatable member can comprise two or more inlet ports that enable fluid communication between the inlet ports and the three-dimensional form of the inflatable member. In this manner, the inflatable member can be interconnected with two or more connectors at the respective inlet ports in order to permit passage of the fluid thereby through the three-dimensional form, for example, to enable fluid communication with an additional inflatable member that is coupled to one of the connectors to which the inflatable member is itself coupled. Thus, a plurality of inflatable members can be interconnected to each other in an end-to-end or arrayed configuration to facilitate fluid communication between the connectors and the inflatable members so that a single inflation point of the structure can be used to inflate all of the inflatable members by virtue of their fluid communication with each other.

The connector(s) of the structure can comprise one or more connecting arms that are configured to be coupled to a respective inflatable member.

For example, the connector can have a single connection arm that can be coupled to an inflatable member and, optionally, an inflation port to which an inflation device can be coupled for driving a fluid into the inflatable member through the connector.

In accordance with some embodiments, the inflation port can be configured to be coupled to a connector arm of another connector in addition to or instead of an inflation device.

Further, in some embodiments, the connector can also comprise a plurality of connecting arms without an inflation port so that the connector is used only to interconnect a plurality of inflatable members. The connector can comprise a two-way, three-way, four-way, five-way, six-way, or other multiple-way connection arm configuration so as to be able to interconnect that respective number of inflatable members to each other in fluid communication. In this manner, the connector can provide a fluid communication between the respective inflatable members.

In accordance with some embodiments, the connector can be configured to allow the connection arms(s) to rotate relative to a body of the connector. The connection arm can be adjusted to an appropriate or desired orientation relative to the connector body, based on the specific application or shape of the structure being formed. This articulation can be particularly useful when the connector is used to interconnect a plurality of inflatable members.

In some embodiments, a connection arm of the connector can be configured to rotate or articulate up to 15 degrees relative to a first position of the connection arm, up to 30 degrees relative to a first position of the connection arm, up to 45 degrees relative to a first position of the connection arm, up to 60 degrees relative to a first position of the connection arm, up to 75 degrees relative to a first position of the connection arm, or up to 90 degrees relative to a first position of the connection arm.

The rotation of the connection arm can permit the connection arm to articulate or move to a position wherein a plurality of connection arms are rotated such that distal ends thereof are brought closer together or converge toward each other, or in opposite directions, such that the distal ends do not move toward each other or converge towards each other.

For example, in some embodiments, the connector can comprise a connector body having a flat or plate-shaped configuration and a plurality of connection arms that are coupled around a perimeter of the flat connector body. The connection arms can be swiveled, rotated, or pivoted collectively so that they all move toward a single point together and tend to converge toward each other.

Optionally, one or more of the arms can also be configured to be rotated in an opposite direction of the other connection arms. Such unique articulation of the connection arms can allow the connector to define a generally concave shape for the portion of the structure corresponding to that connector, a generally flat shape for the portion of the structure corresponding to that connector, or a surface point that creates an intersection of diverging surfaces or a convergence of planes that are angled relative to each other.

BRIEF DESCRIPTION OF THE DRAWINGS

The accompanying drawings, which are included to provide further understanding and are incorporated in and constitute a part of this specification, illustrate disclosed embodiments and together with the description serve to explain the principles of the disclosed embodiments. In the drawings.

DETAILED DESCRIPTION

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, it will be apparent to those skilled in the art that the subject technology may be practiced without these specific details. In some instances, well-known structures and components are shown in block diagram form in order to avoid obscuring the concepts of the subject technology. Like components are labeled with identical element numbers for ease of understanding.

Referring now to the figures, various aspects of embodiments of the present disclosure are illustrated in FIGS. 1-24. The features illustrated in these figures and discussed herein can be incorporated into various systems, structures, and components. The system can provide a structure that can be inflated and deflated in order to provide a structure that is temporarily, selectively expandable to a deployed configuration and, when desired, collapsible to a stowed configuration.

Figure 1:
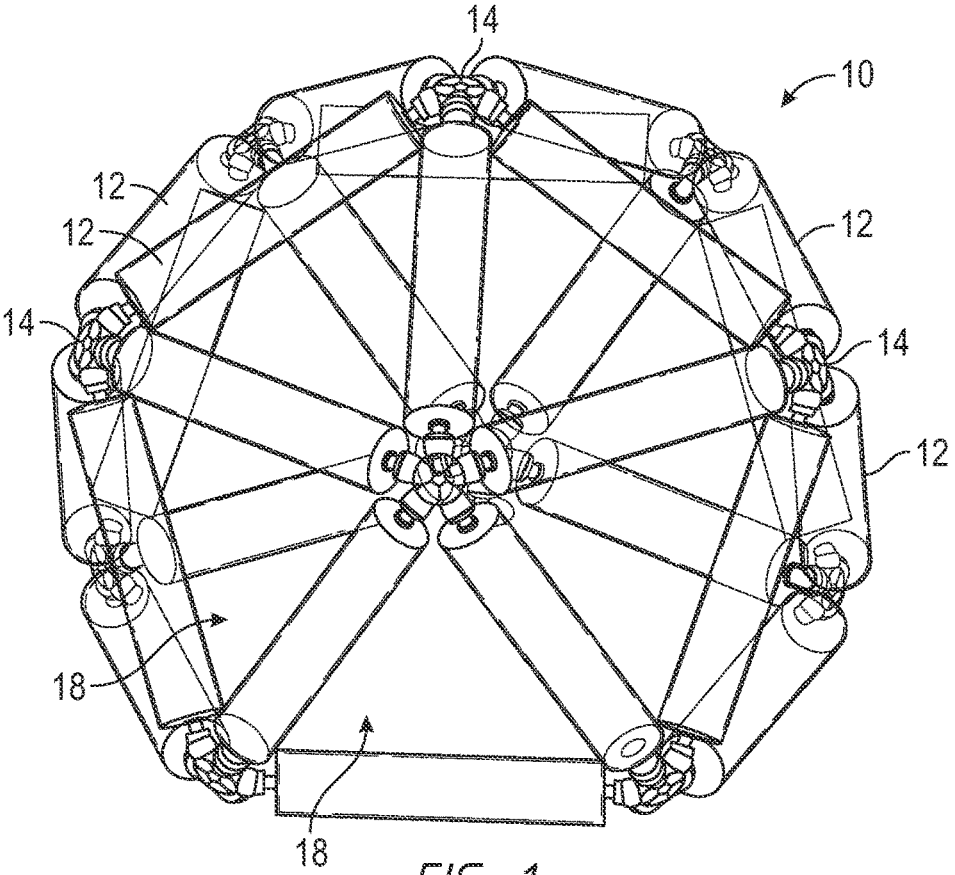
FIG. 1 is a perspective view of an inflatable structure, according to some embodiments.
Figure 2:
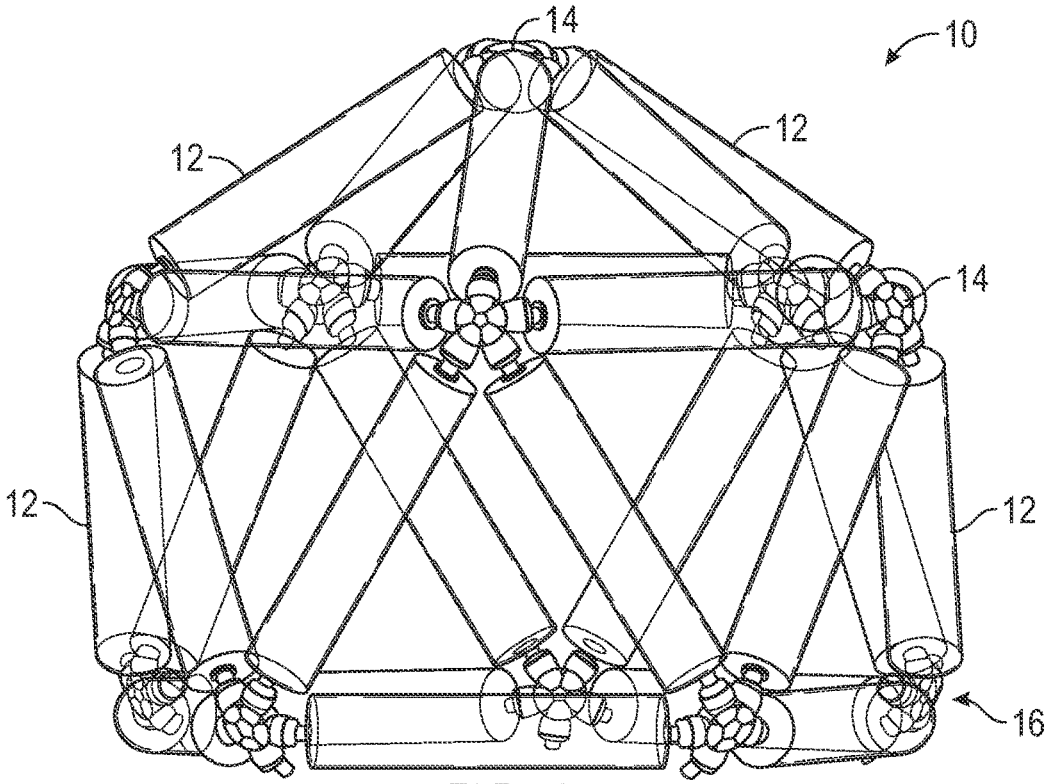
FIG. 2 is a side view of the inflatable structure of FIG. 1, according to some embodiments.

Referring now to the figures, FIG. 1 illustrates an example of one of the many different three-dimensional shapes that can be made using the components of the structure discussed herein. FIG. 1 is an embodiment of an inflatable structure 10 that comprises a plurality of inflatable members 12 and connectors 14. FIGS. 1 and 2 illustrate perspective and side views, respectively, of the structure 10. The structure 10 can have a three-dimensional design.

For example, the structure 10 can have a pentagonal base 16. However, other shapes, such as rectangular, square, hexagonal, triangular, or other polygonal shapes can be implemented, as well as to have one or more interconnecting inflatable members 12 that span the base to interconnect sides of the base 16. Further, the three-dimensional shape of the structure can be determined based on the intended application or other considerations, providing a vast array of shapes, sizes, and uses for the consumer.

As shown in the embodiment of FIGS. 1 and 2, the connectors 14 can be coupled to up to five inflatable members 12 each. As such, the structure 10 can define a plurality of triangular faces 18, which are themselves defined by adjacent inflatable members 12 about an exterior of the structure 10. Advantageously, when inflated, such a design of the structure 10 can provide a substantially rigid and stiff structure that utilizes a trigonal framework. As such, the structure 10 can be a stable structure, useful in a variety of applications.

The stability and integrity of the structure 10 is an example of some of the capabilities and utility of the inflatable structures disclosed and taught herein through the various examples and disclosure. Further, not only can the structure 10 provide a reliable and stable framework, but the structure 10 can also enable a user to incorporate various optional features, such as lighting and shade components, as well as any of the variety of components and features noted above.

Referring now to FIGS. 3-10, various features of the connector 14 are illustrated, which can be used with the structure 10. As shown, the connector 14 can comprise one or more connector arms 20 that are coupled to a body 22 of the connector 14.

According to some embodiments, the connector 14 can be coupled to one or more inflatable members 12. The connector 14 can also be used to interconnect two or more inflatable members 12.

In some embodiments, the body 22 of the connector 14 can be configured to permit fluid communication between two inflatable members 12 that are coupled to the connector 14. Thus, the connector 14 can facilitate fluid movement between one inflatable member 12 and an adjacent inflatable member 12 that are both coupled to the connector 14.

The body 22 can optionally comprise a material that permits one or more portions of the body to bend or flex. The body 22 can comprise both flexible and rigid portions, such as flexible sockets where to the connector arms 20 can be coupled and a flexible inflation port 80 were to an inflation mechanism or other connector arm can be attached. In some embodiments, the inflation port 80 can bend or deflect to permit flexibility and adjustability similar to the ball-and-socket joint of the connector arms 20, but with less complexity than the ball-and-socket joint.

Further, the body 22 itself can be flexible to permit relative movement between the sockets and connector arms 20. Accordingly, any inflatable members coupled to the connector 14 can be permitted to flex or bend relative to each other.

Additionally, the body 22 can comprise a pad or cushioned exterior or layer. Accordingly, if a user is contacted by a connector during use, a padded body of the connector can advantageously provide some protection against harm or trauma.

For example, the body 22 can comprise a mix of rigid or hard plastic and flexible and/or soft material. For example, the connector arm 20 can comprise a generally spherical connection surface 52 that is engaged against a generally spherically shaped surface 54 of a socket 56 of the body 22. The socket 56 of the body 22 can be formed from a hard plastic or other rigid material. This can permit the ball-and-socket joint to provide both a secure interconnection between the connector arm 20 and the body 22 while also permitting the connector arm 20 to translate, swivel, pivot, or rotate relative to the body 22.

The connector 14 can be formed from a material that is rigid and/or flexible. In some embodiments, the connector arm 20 can comprise a generally spherical connection surface 52 formed from a hard material, such as a hard plastic, that mates against a hard plastic of the socket 56 of the body 22.

Optionally, in some embodiments, a portion of the connector arm 20, such as at least an intermediate length thereof, can comprise a flexible material that permits deflection of a farthest-most position of second or distal end portions 72 of the connector arm 20 relative to the spherical connection surface 52 of the connector arm 20.

The connector arm 20 can optionally be configured to define a longitudinal length or extent between the spherical connection surface 52 and the distal end portions 72. In some embodiments in which a portion of the connector arm 20 is formed from a flexible material, the connector arm 20 can be manipulated or bent to a desired angular orientation in order to provide increased flexibility and alternative configurations, as well as the benefit of ease of assembly, which may be facilitated by permitting slight adjustability as the connector arm 20 is brought into connection with another component, such as another connector or an inflatable member.

The connector 14 can incorporate only hard connector arms, only soft connector arms, or a mix of hard and soft connector arms. The connector can be configured to permit the user to interchange connector arms at will in order to permit the user to tailor a given system based on structural, functional, or other requirements thereof.

Additionally, in some embodiments, the connector arm 20 can be formed as a single continuous piece with the body 22 of the connector 14 (i.e., the connector arm is formed integrally with the body). As such, the body can be formed continuously with one or more connector arms, with each connector arm defining a predetermined orientation relative to the body. In such embodiments, the connector arm can comprise a flexible portion that allows the connector arm to bend or pivot relative to the body in order to provide some adjustability of the connector arm relative to the body. Accordingly, such embodiments can allow the connector to have one or more deflectable or adjustable connector arms without using ball-and-socket joints or other hinged connections between the body and the connector arm, but instead provide a single-component connector in which the body and connector arm(s) or formed from a single, continuous material. Nevertheless, such embodiments can also be configured to comprise one or more sockets or joints where to a separately formed connector arm can be coupled, in addition to connector arms that are formed integrally with the body.

In some embodiments, the connector arm 20 can be coupled to the body 22 to permit movement of the connector arms 20 relative to the body 22. Such movement can enable the connector arms 20 to translate, swivel, pivot, or rotate relative to the body 22.

Figure 3:
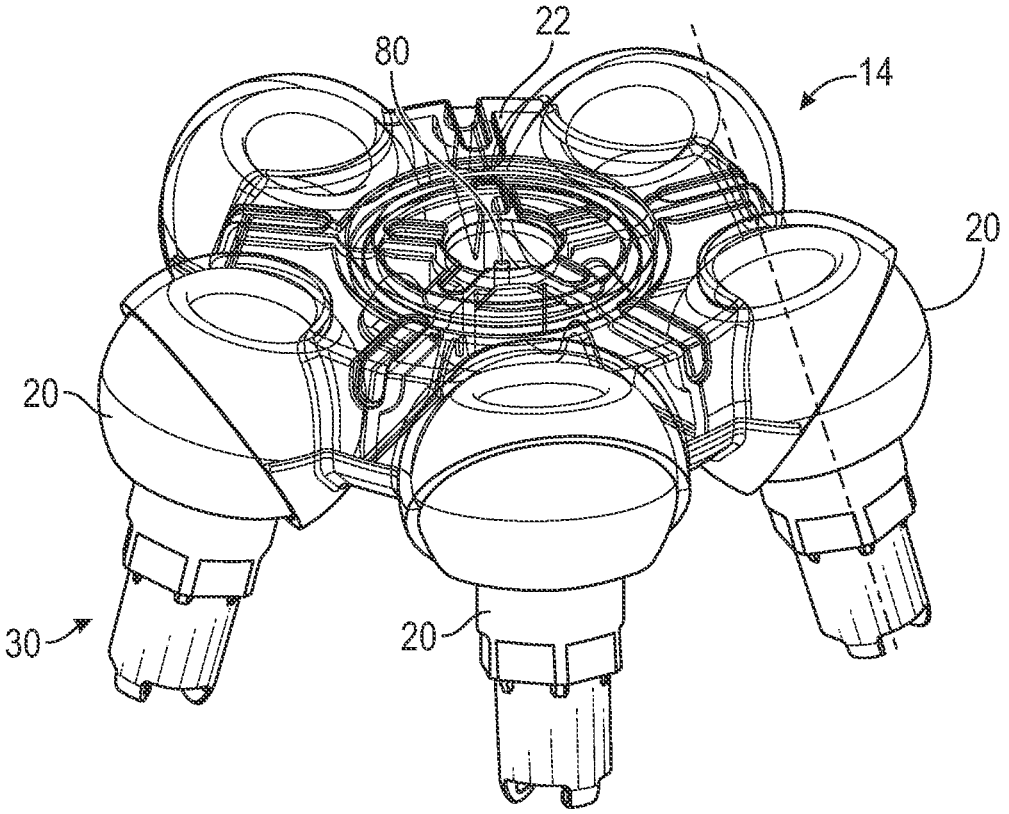
FIG. 3 is a top perspective view of a connector of the inflatable structure of FIG. 1 in which connector arms of the connector are in a first position, according to some embodiments.

As illustrated in FIGS. 3-6, the connector arms 20 can be moved to a variety of positions relative to the body 22. FIG. 3 illustrates a top perspective view of the connector 14 in which the connector arms 20 are positioned in a downwardly inflected position 30. The downwardly inflected position 30 can represent a farthest-most position of second or distal end portions 72 of the connector arms 20 relative to the body 22.

Figure 4:
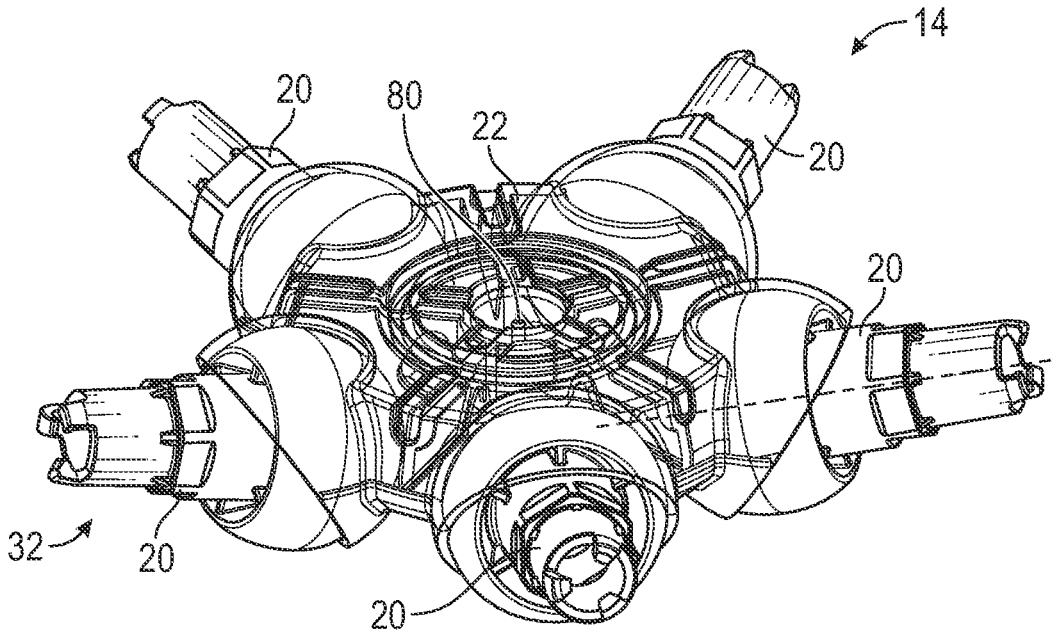
FIG. 4 is a top perspective view of the connector of FIG. 3 in which connector arms are in a second position, according to some embodiments.

FIG. 4 illustrates the connector arms 20 in an upwardly inflected position 32. The upwardly inflected position 32 can represent an opposite position relative to the downwardly inflected position 30. In moving between the downwardly inflected position 32 and the upwardly inflected position 32, a connector arm 20 can swivel, rotate, or pivot about an angle of up to about 90 degrees or more. The range of motion of a connector arm 20 relative to the body 22 can be an angle of up to about 15 degrees, up to about 30 degrees, up to about 45 degrees, up to about 60 degrees, up to about 75 degrees, up to about 90 degrees, up to about 105 degrees, or more.

Figure 5:
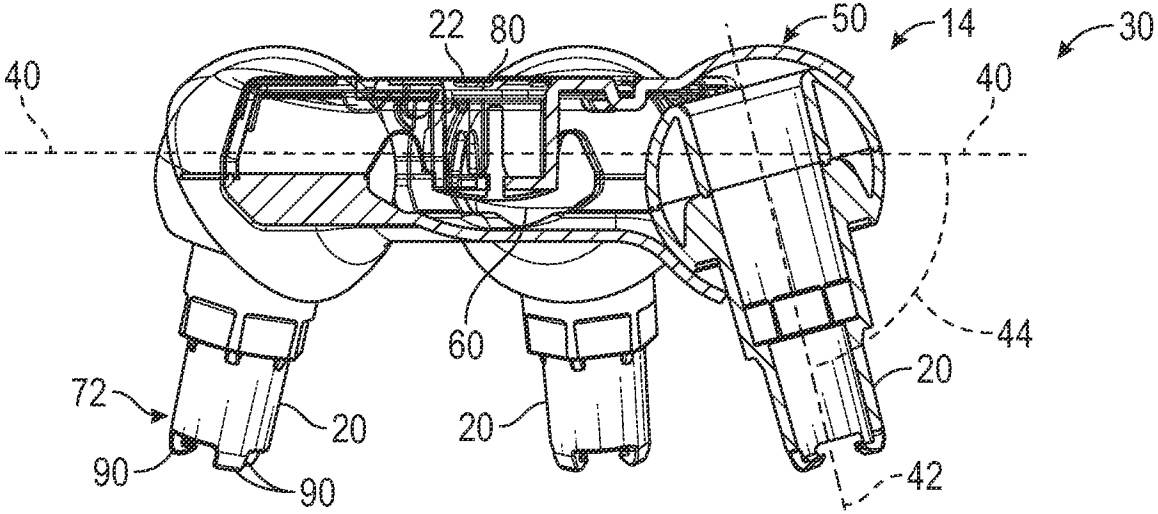
FIG. 5 is a side, cross-sectional view of the connector shown in FIG. 3.
Figure 6:
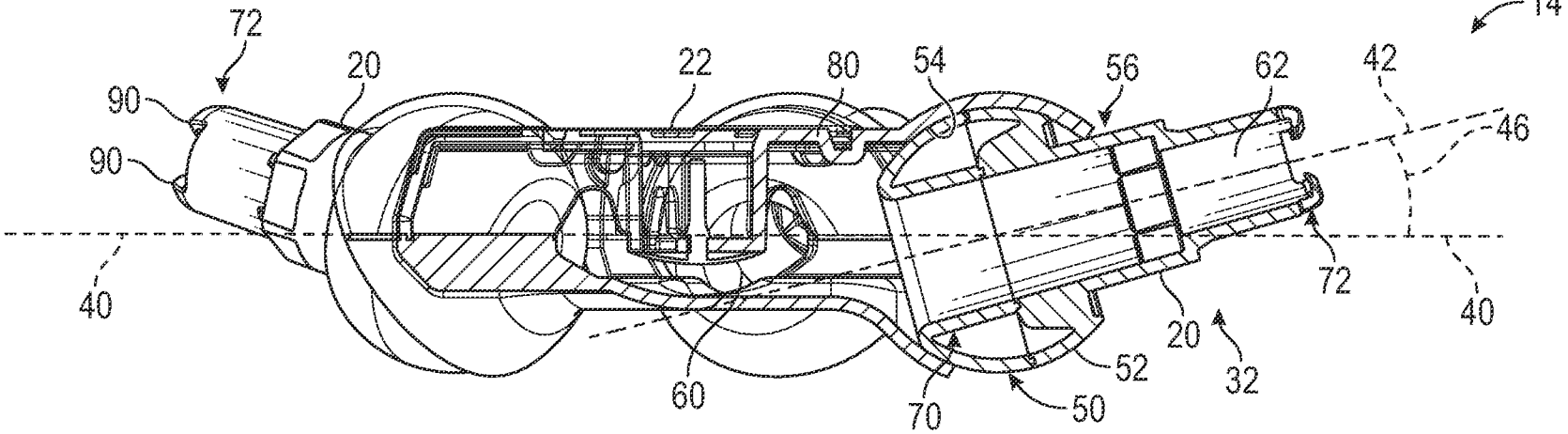
FIG. 6 is a side, cross-sectional view of the connector shown in FIG. 4.

In measuring the range of motion of a given connector arm 20, the body 22 of the connector 14 can define a plane 40 that passes through the body 22 and the connector arms 20. As shown in FIGS. 5 and 6, a central axis 42 of the connector arm 20 can be angled relative to the connector plane 40 at an inflection angle. For example, in FIG. 5, the central axis 42 of the connector arm 36 defines a downward angle 44, relative to the plane 40. Further, in FIG. 6, the connector arm 20 is rotated to the upwardly inflected position 32 to define an upward angle 46 between the central axis 42 of the connector arm 20 and the plane 40 of the body 22 of the connector 14.

In accordance with some embodiments, the downward angle 44 can be in the range of 0 degrees and about 15 degrees, about 0 degrees in about 30 degrees, about 0 degrees about 45 degrees, about 0 degrees and about 60 degrees, about 0 degrees about 75 degrees, or greater. Similarly, the upward angle 46 can be between about 0 degrees and about 15 degrees, about 0 degrees in about 30 degrees, about 0 degrees about 45 degrees degrees, about 0 degrees and about 60 degrees, about 0 degrees about 75 degrees, or greater.

As illustrated in FIGS. 5 and 6, the connector arm 20 can be coupled to the body 22 using a ball-and-socket configuration 50. For example, the connector arm 20 can comprise a generally spherical connection surface 52 that is engaged against a generally spherically shaped surface 54 of a socket 56 of the body 22. As may be appreciated by personal skill in the art, this ball-and-socket configuration 50 can enable the connector arm 20 to be in fluid communication with an interior cavity 60 of the body 22.

In some embodiments, the connector arm 20 can define an interior passage 62 that extends from a first end portion 70 to a second or distal end portion 72 of the connector arm 20. The first end portion 70 of the interior passage 62 of the connector arm 20 can be open toward the interior cavity 60 of the body 22. The interior cavity 60 can be in fluid communication with one or more of the sockets 56 in order to permit one or more of the connector arms 20 to be in fluid communication with the body 22 and/or with each other.

Referring again to FIGS. 3 and 4, the body 22 can comprise an inflation port 80 that is in fluid communication with the interior cavity 60 of the body 22. The inflation port 80 can be used to couple an inflation device (not shown) thereto so that a user may drive fluid into the interior cavity 60 of the body 22, thereby inflating any fluidly connected connector arms, 20 and inflatable members, coupled respectively thereto.

Accordingly, the connector 14 can optionally include an inflation port 80 that allows the connector 14 to be used to drive fluid toward one or more inflatable members 12. However, in some embodiments, the connector 14 can be designed without an inflation port 80. In such embodiments, the connector 14 can provide fluid communication between or amongst inflatable members that are all respectively coupled to the connector 14.

In yet other embodiments, the connector 14 can be configured to occlude or block fluid flow to/from one or more of the inflatable members coupled to the connector 14. For example, the connector 14 can be configured with a solid body 22 that does not provide any fluid communication between respectively coupled inflatable members 12. However, the connector 14 can also be configured such that the body 22 permits fluid communication between two or more inflatable members and prevents fluid communication to/from one or more other inflatable members.

As noted above, the inflatable structures and/or connectors of the system disclosed herein can be formed to include one or more valve features to selectively permit or restrict fluid communication therethrough.

In some embodiments, the connector can have one or more valves to control fluid flow therethrough.

In some embodiments, the inflatable structure(s) can have one or more valves to control fluid flow therethrough.

Further, in some embodiments, neither the connector nor the inflatable structure(s) can have one or more valves to control fluid flow therethrough.

Furthermore, in some embodiments, both the connector and the inflatable structure(s) can have one or more valves to control fluid flow therethrough.

If used in some embodiments of the system, a valve can be opened and/or closed manually by the user and/or by an interaction with the inflatable member or connector, thereby permitting fluid communication between the inflatable structure and the connector.

For example, the connector 14 can be configured to include a valve (e.g., a one-way valve) at one or more of the sockets 56 or in the connector arm 20. In accordance with some embodiments, a one-way valve can be incorporated into the interior passage 62 of each connector arm 20. The one-way valve can allow flow into or out of the connector arm 20.

For example, a connector arm 20 can be configured to permit flow through the interior passage 62 thereof only upon interconnection of the connector arm 20 with a respective inflatable member 12.

The connector arm 20 can comprise one or more engagement prongs 90 along the second end portion 72 of the connector arm 20, as shown in FIGS. 5 and 6. The engagement prongs 90 can extend distally from the second end portion 72. However, the engagement prongs 90 can also be positioned about the perimeter or periphery of the connector arm 20 in a manner that enables a suitable interconnection with a respective inflatable member 12. Various designs and configurations for permitting engagement between the connector arm 20 and the inflatable member 12 can be implemented.

Optionally, upon engagement between the connector arm 20 and the inflatable member 12, the one-way valve of the connector arm 20 can be disengaged so as to permit flow through the interior passage 62 of the connector arm 20 and the inflatable member 12. A grub or connector piece can be coupled to the connector arm 20 or the inflatable member 12 and be configured to enter and/or open the valve when the connector arm is coupled to another connector arm or inflatable member.

Some embodiments can be configured to include a valve in the connector arm 20 that may permit flow out of the connector 14 into the inflatable member 12, but also generally prevent flow from the inflatable member 12 toward the connector 14. Such a design may be useful for a designated inflation connector whereto an inflation device is coupled for driving fluid into the structure 10. However, such an inflation connector can also include a single one-way valve incorporated into the inflation port 80 instead of or in addition to other one-way valves incorporated into the connector arms 20 or body 22 of the connector 14.

The connector arms of the connector can be configured to be coupled to a respective inflatable member. The coupling between the inflatable member and a connector arms can enable or provide a secure interconnection between the inflatable member and the connector.

Figure 7:
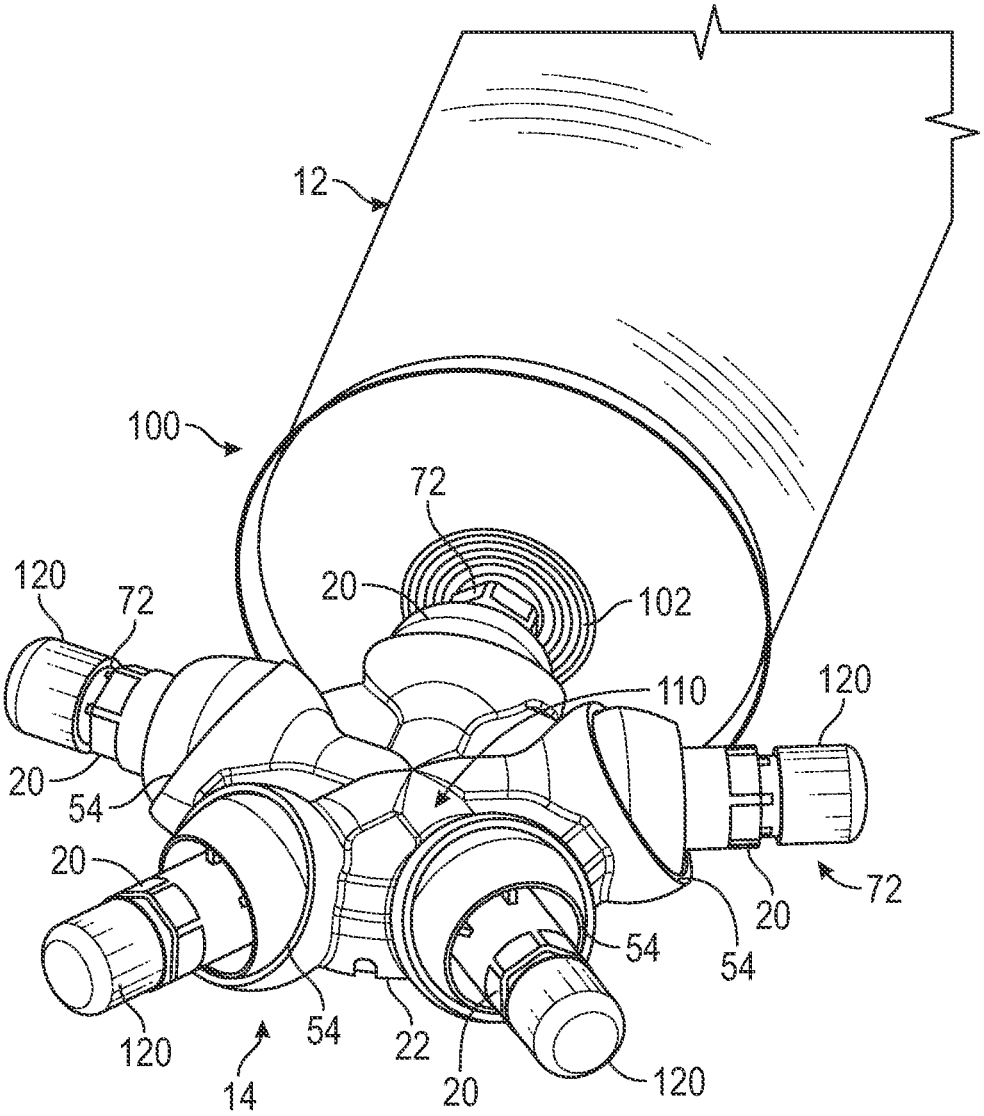
FIG. 7 is a perspective view of an interconnection of a connector and an inflatable member, according to some embodiments.

For example, referring now to FIGS. 7-10, the between a connector 14 and an inflatable member 12 is shown in various views. As illustrated in FIG. 7, the connector 14 can be coupled to the inflatable member 12 at a first end portion 100 of the inflatable member. The first end portion 100 can comprise a connection socket 102 into which a second end portion 72 of the connector arm 20 can be inserted. As noted above, the second end portion 72 of the connector arm 20 can engage and be fixedly coupled to the inflatable member 12. The connection socket 102 can comprise respective engagement features, such as prongs, detents, grooves, or other such features, which can engage with and ensure a secure coupling between the connector arm 20 and the connection socket 102.

In some embodiments, the system can be configured such that the joint between the connector arm 20 in the connection socket 102 provides a substantially rigid connection. The system can be configured to preferentially permit flexion in the inflatable member 12 (to support any significant bending stresses or other loads placed on the structure in the area localized around a given connector and inflatable member(s)) rather than permitting the joint itself to potentially act as a point of structural failure.

Figure 8:
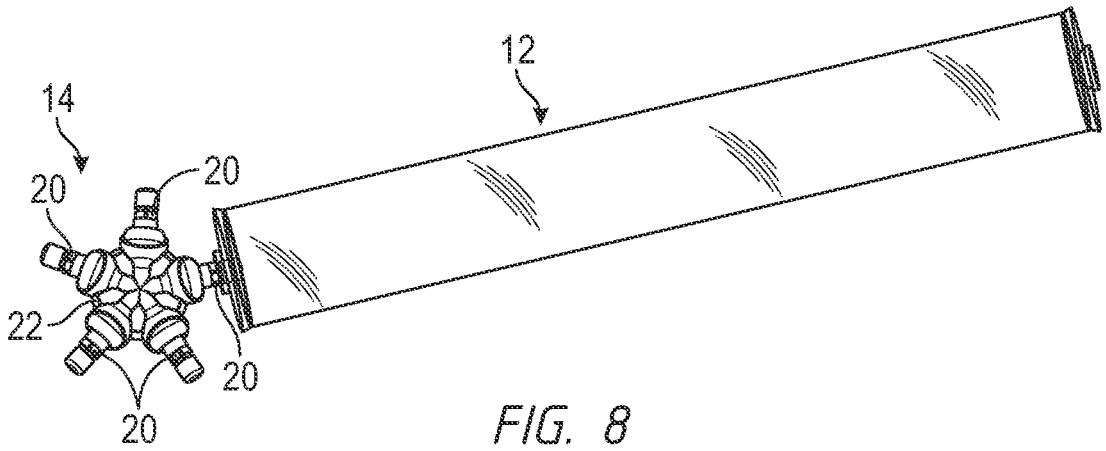
FIGS. 8-10 illustrate top and side views of the interconnection of the connector and the inflatable member shown in FIG. 7, according to some embodiments.
Figure 9:
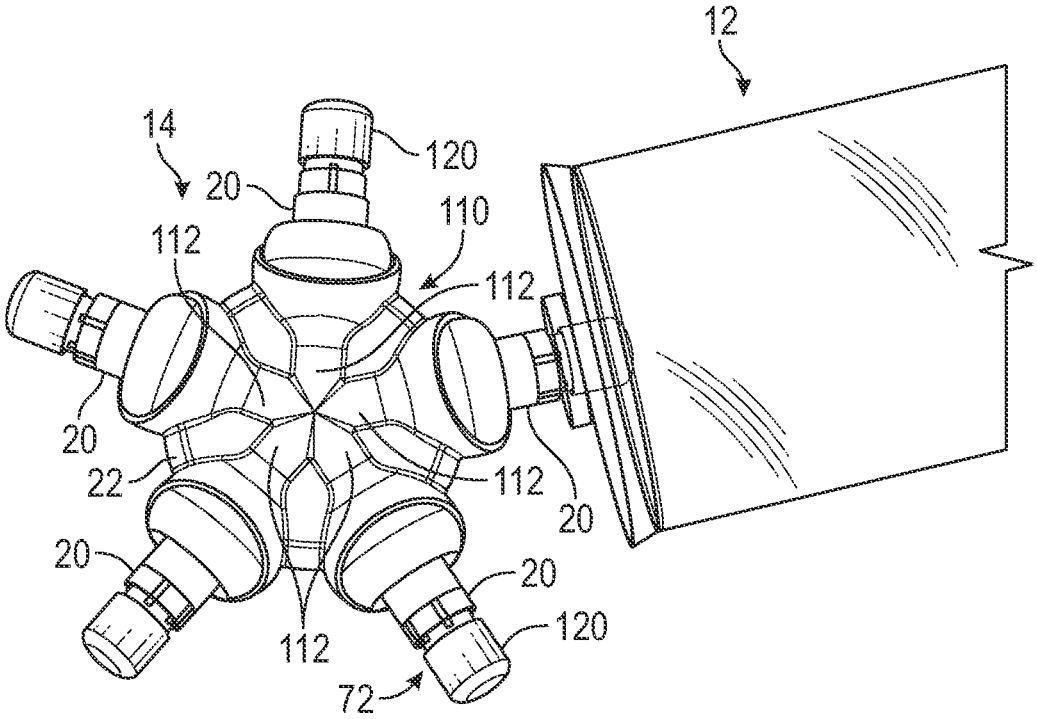
Figure 10:
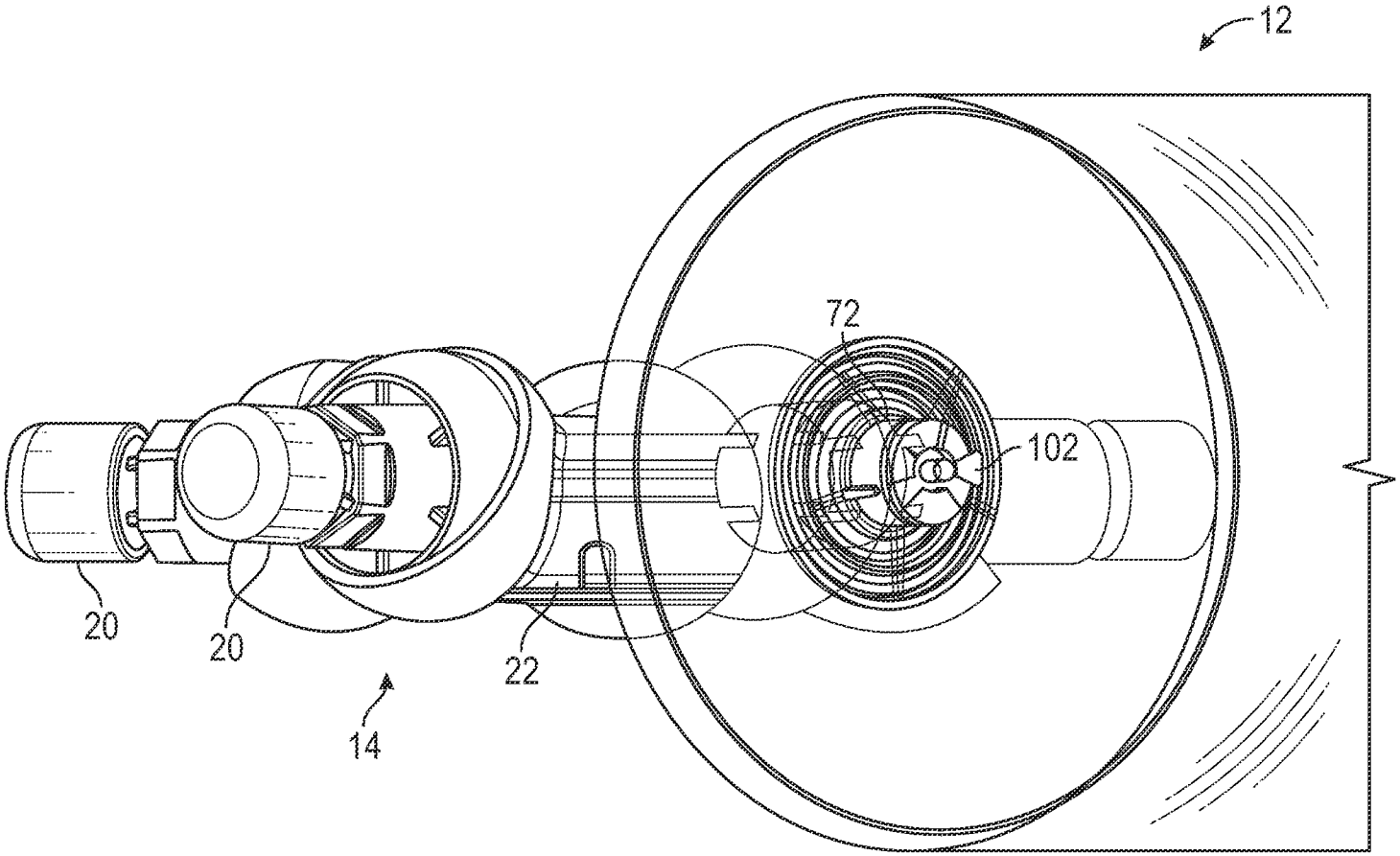

For example, in some embodiments, FIGS. 7-10 illustrate that a substantially rigid interconnection can be provided through secure, deep engagement between the second end portion 72 of the connector arm 36 into the connection socket 102. For example, in some embodiments, about ⅓ to ½ of the length of the connector arm 20 can be inserted within or longitudinally overlapped with the connection socket 102 to be securely coupled to the connection socket 102. Further, in some embodiments, about ⅓ to ⅔ of the length of the connection arm 20 can be coupled to the connection socket 102. Advantageously, at least about ⅓ or at least about ½ of the length of the connector arm 20 can be inserted within or longitudinally overlapped with the connection socket 102 to create a superior, rigid joint that demonstrates high bending strength. FIG. 10 illustrates a cut-away view of the wall of the inflatable member 12 to show the connection socket 102 from within the tubular member 12.

Additionally, FIGS. 7-9 illustrate an embodiment of a manifold arrangement 110 for the connector body 22. The manifold arrangement 110 can comprise a plurality of hollow channels 112 that interconnect the sockets 56 of the body 22 in order to permit fluid communication between the connector arms 20 and any inflatable members 12 coupled thereto.

Optionally, the connector 14 can comprise endcaps 120 that can be coupled to the second end portion 72 of the connector arms 20. In some embodiments, the endcaps 120 can be secured to and prevent outflow of air from the connector arms 20. In accordance with some embodiments, the endcaps 120 can also provide a protection for and/or prevent debris ingress at the second end portions 72 of the connector arms 20. In particular, the endcaps 120 can protect the engagement prongs 90 and help ensure that the second end portions 72 to the connector arms 20 remain clean and free of debris or other particulates.

In some embodiments that incorporate valves into the connector arms 20 themselves, the endcaps 120 can also serve to block flow through the connector arms 20. Although either of these two components—the valves of the connector arms 20 (when used in the design) and the endcaps 120—can facilitate and tend to ensure that the fluid pressure in the system is not compromised and remains at a desired level during use of the system 10.

As also illustrated in FIGS. 7-10, the ball and socket joint 50 of the connector 14 can permit the connector arm 20 to swivel, rotate, or pivot to a plurality of different positions, articulating up and down or side-to-side with respect to a given structure or plane of the connector 14. In some embodiments, the interconnection of the connector arm 20 and the body 22 of the connector 14 can permit rotary articulation in order to enable a variety of unique configurations and positions of the connector arm 20, thereby allowing the shape of the structure 10 to be specifically articulated to a given design.

As noted previously, the connector can be configured to include a plurality of connector arms, be arranged in different shapes or configurations, and provide other structural or functional features for a particular application. FIGS. 11-18, 23, and 24 illustrate various views of alternative connector designs that can be used in accordance with some embodiments of the structure disclosed herein. The connector designs illustrated and describe in the present disclosure can be modified and/or used in any combination. For example, any of the connector designs in FIGS. 1-18, 23, and 24 can be used in any combination with each other or by themselves in a given structure or structure kit, in accordance with certain embodiments.

Figure 11:
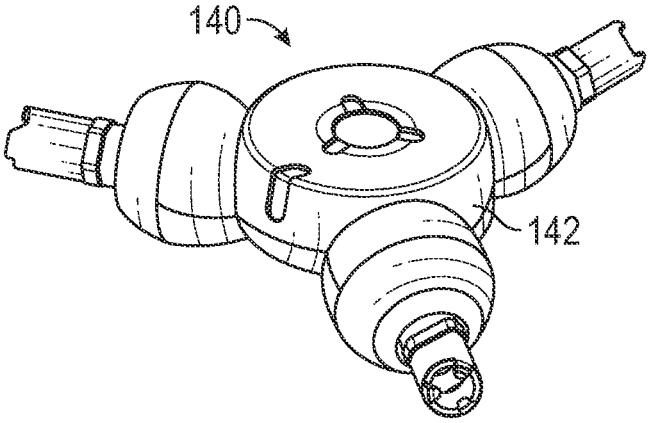
FIGS. 11-18 illustrate alternative embodiments of connectors that can be used in accordance with embodiments of the inflatable structure disclosed herein.
Figure 12:
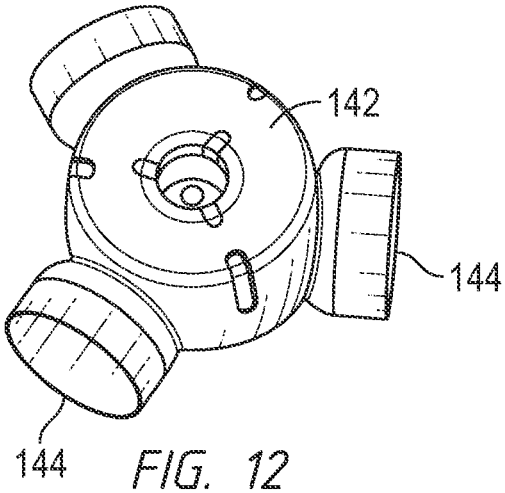
Figure 13:
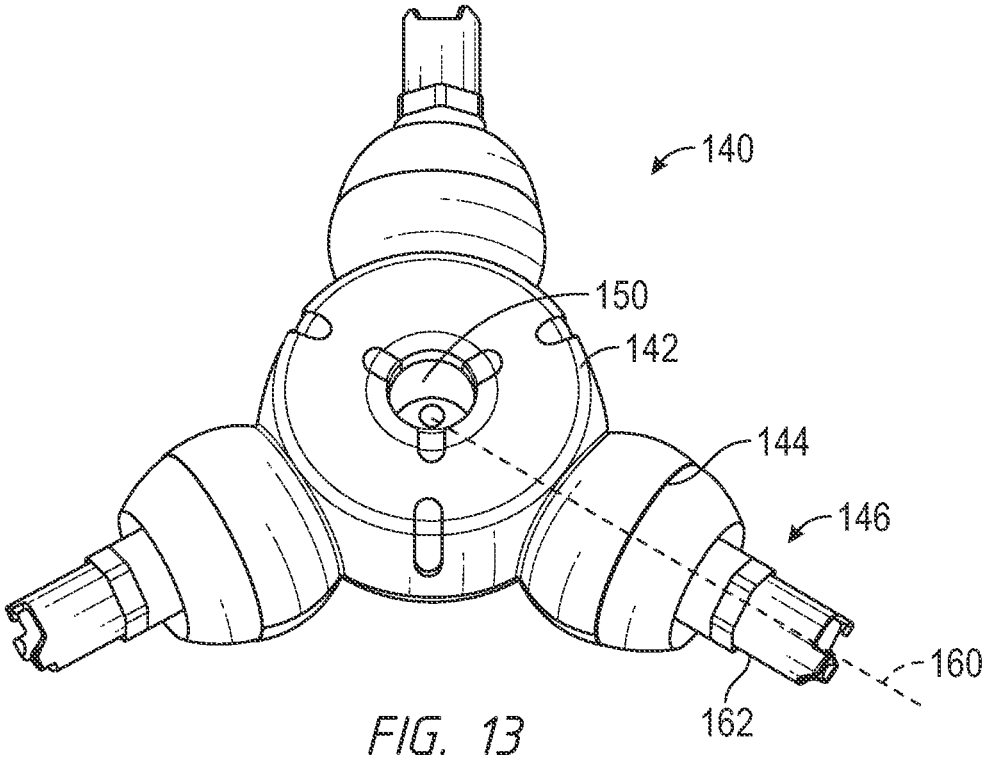

FIGS. 11-13 illustrate an embodiment of a connector 140 in which the connector 140 comprises a connector body 142 having a plurality of connection sockets 144 into which a connector arm structure 146 can be mounted. The connector body 142 can comprise an inflation port 150 that can be coupled to an inflation device and/or a connector arm of another connector of the structure. The connector arm structure 146 can function in a manner similar to the ball and socket connector arm of the connector 14 discussed above. However, the connector arm structure 146 can provide a range of rotary movement that is approximately symmetrical about a connection axis 160, as shown in FIG. 13. As such, they connector arm 162 of the connector arm structure 146 can swivel, rotate, or pivot about the connection axis to a desired position relative to the body 142 of the connector 140.

Figure 14:
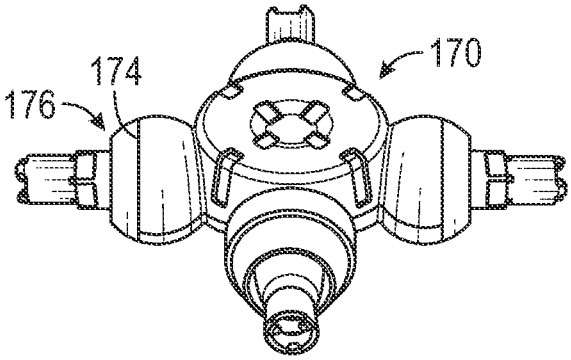
Figure 15:
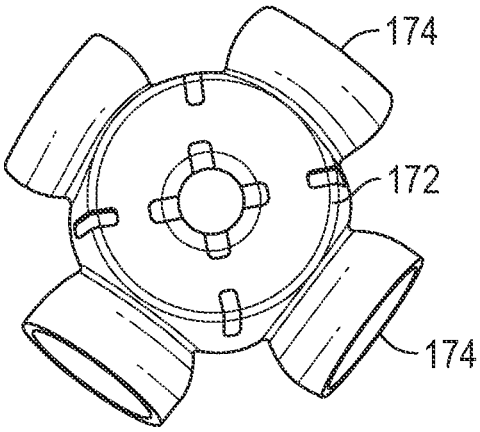
Figure 16:
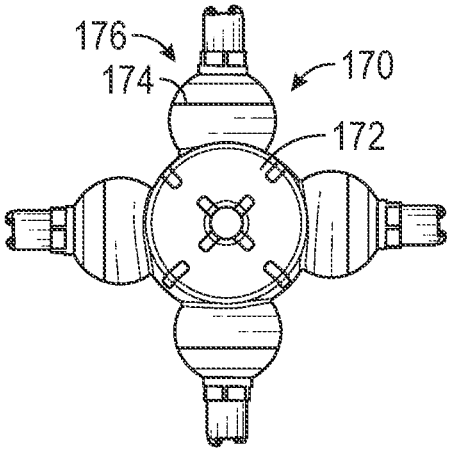

The connector 140 shown in FIGS. 11-13 also illustrates that the connector can comprise three connector arms extending therefrom. In this regard, FIGS. 14-18 illustrate similar, alternative embodiments of connectors. For example, FIGS. 14-16 illustrate a connector 170 having a connector body 172 that comprises four sockets 174 to which are coupled respective connection arm structures 176.

Figure 17:
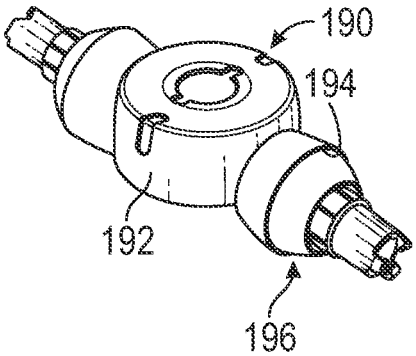
Figure 18:
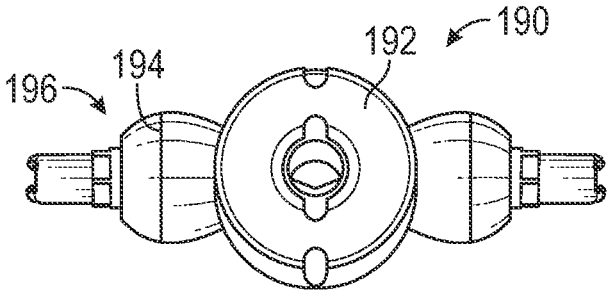

Additionally, FIGS. 17 and 18 illustrate a further embodiment of a connector 190 having a connector body 192 that comprises two sockets 194 to which are coupled respective connection arm structures 196. The additional embodiments of the connectors 170, 190 can also comprise respective inflation ports and other structural features and functional features as disclosed herein for other embodiments.

Further, as with the connector 14, the connectors shown in FIGS. 11-18 can also comprise a flexible and/or padded body.

Accordingly, the bodies of the connectors shown in FIGS. 11-18 can be flexible to permit relative movement between the sockets and connector arms. This can permit any inflatable members coupled to a connector to be permitted to flex or bend relative to each other.

Additionally, the bodies of the connectors shown in FIGS. 11-18 can comprise a pad or cushioned exterior or layer. Accordingly, if a user is contacted by a connector during use (such as during deflation of the structure), a padded body of the connector can advantageously provide some protection against harm or trauma.

The connectors disclosed herein illustrate a variety of connector bodies having sockets that permit the connector arms to have a default or initial position in which the connector arm axes lie in a common plane. However, the connector body can also be configured to permit the connector arm axes to be disposed at about a 90-degree angle with respect to one or more other connector axes of the connector.

In some embodiments, the connector can be configured to have a plurality of connector arms extending from a single point. For example, the connector can be configured as a six-armed connector in which all arms are oriented at a 90-degree angle with respect to another arm. Other connectors can be configured with other angular relationships between respective arms. Some connectors can be configured with connector arms that extend from multiple points (not just a single point). Such embodiments can implement any of the features and structural characteristics disclosed herein.

As noted above, the connectors disclosed herein can be used in forming structures; however, the teachings and disclosure herein provided examples of connector bodies and other features that can be implemented to create any of a variety of useful structures that are suitable for educational, recreational, and commercial applications.

Figure 19:
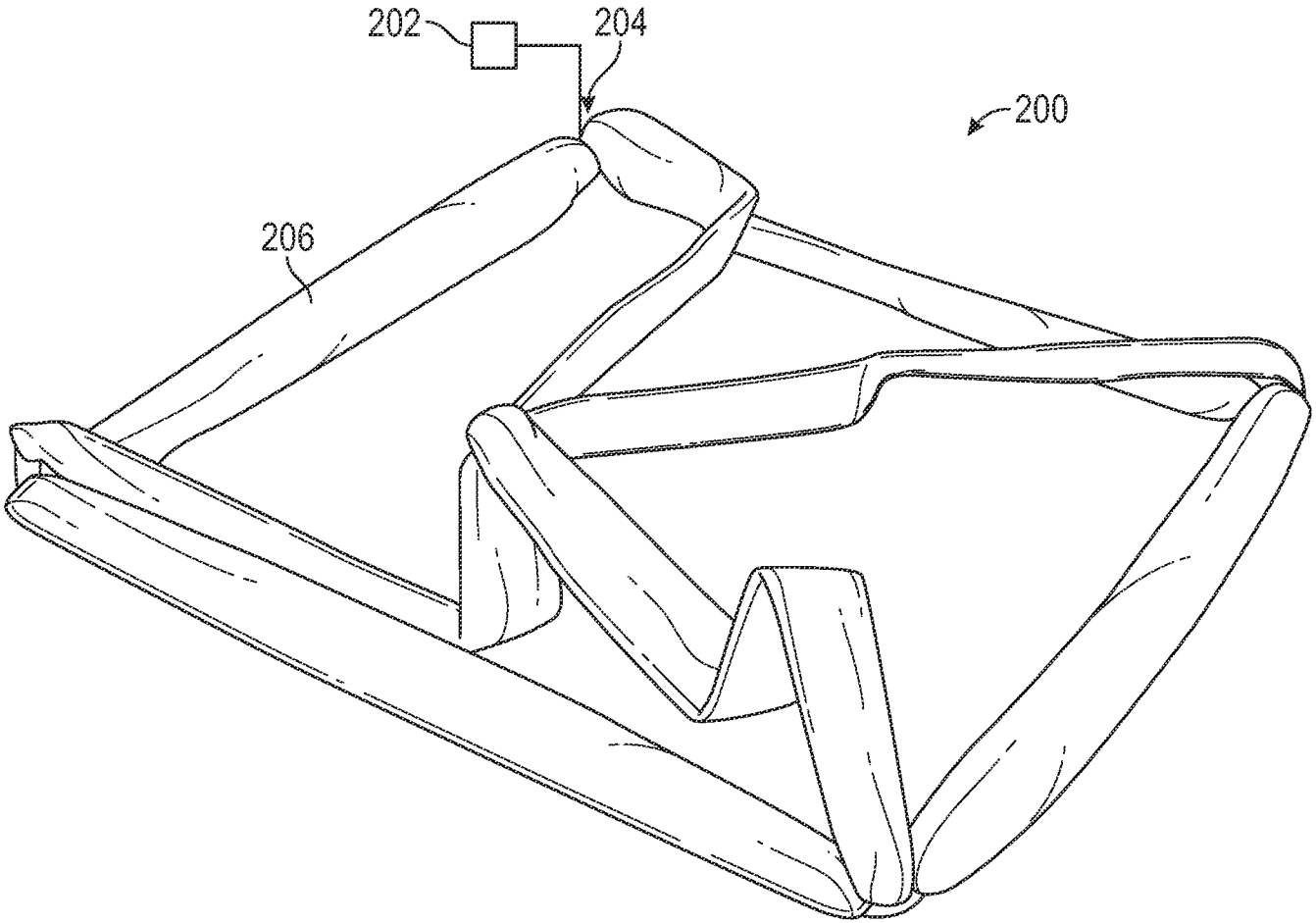
FIGS. 19 and 20 illustrate an exemplary inflatable structure in an uninflated configuration and an inflated configuration, respectively, according to some embodiments.
Figure 20:
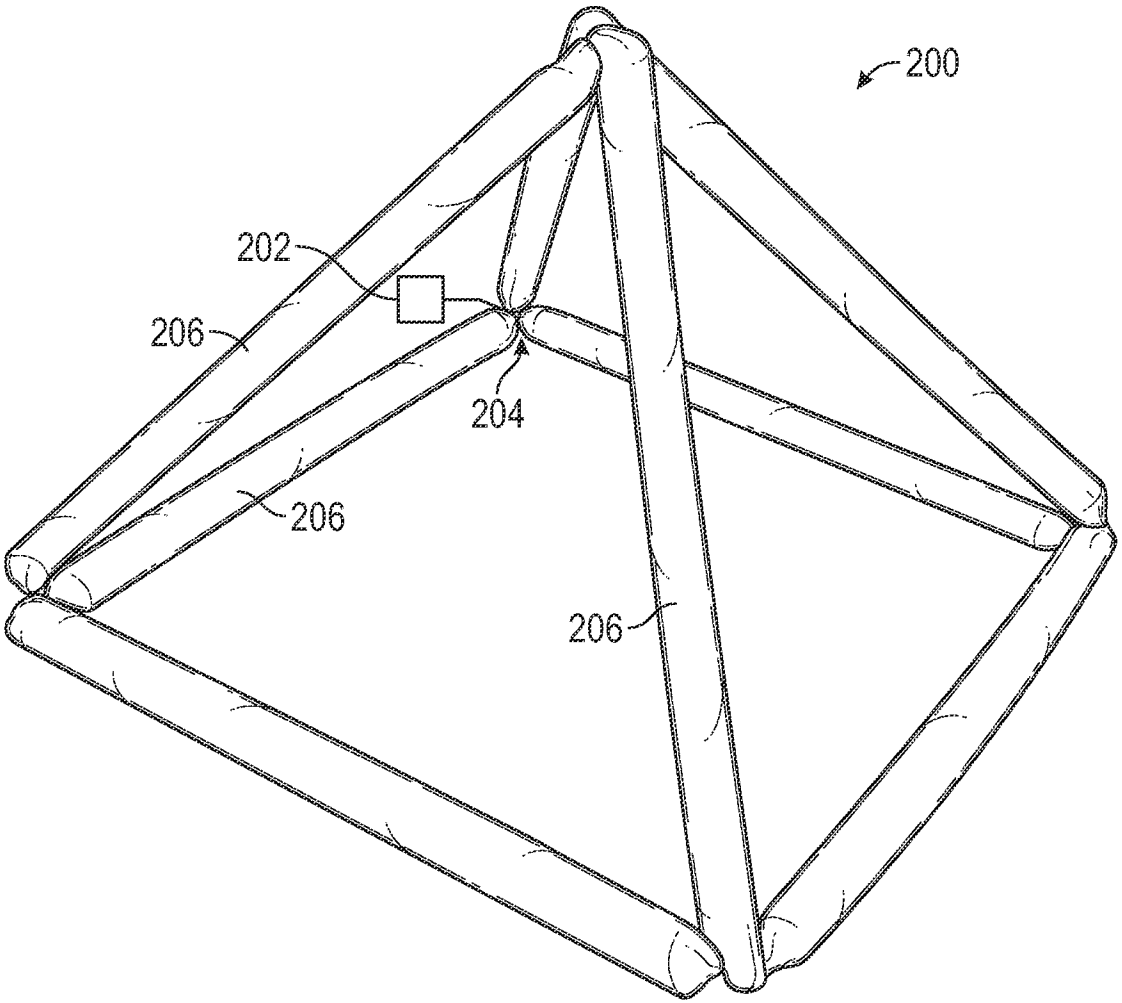

Referring now to FIGS. 19 and 20, the inflation and configurations of a structure 200 are illustrated. FIG. 19 illustrates the structure 200 in an uninflated or collapsed configuration whereas FIG. 20 illustrates the structure 200 in an inflated configuration. As shown, an inflation device 202 can be coupled to a connector 204 of the structure 200. The inflation device 202 can direct air into the connector 204, which can thereby be transferred to the inflatable members 206 of the system. The inflatable members will be pressurized and achieved a rigid or inflated configuration, as shown in FIG. 20. The structure 200 utilizes a pyramid-type design, using connectors that have at least three connection arms.

Figure 21:
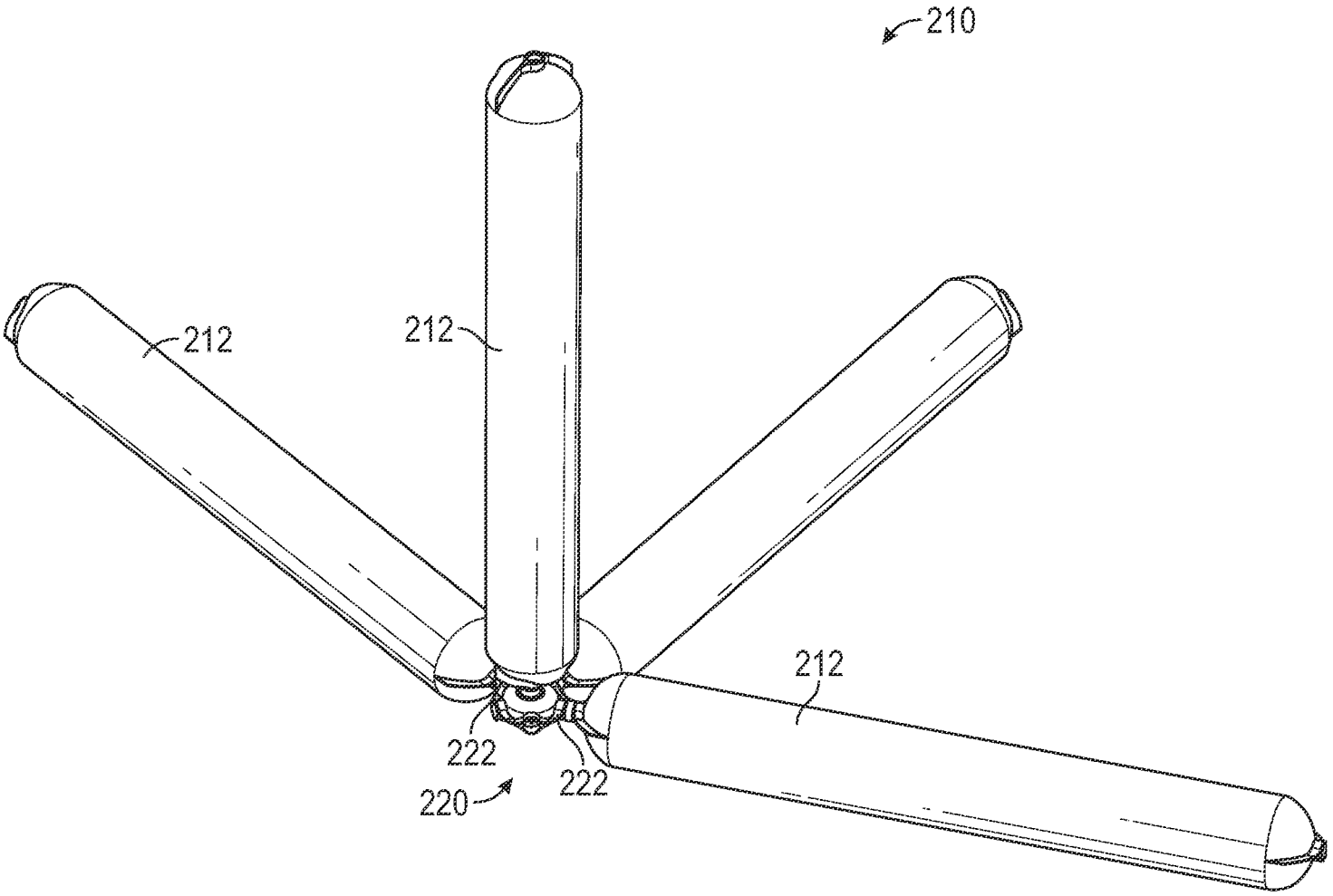
FIGS. 21 and 22 illustrate an inflatable structure having inflatable members and a connector, according to some embodiments.
Figure 22:
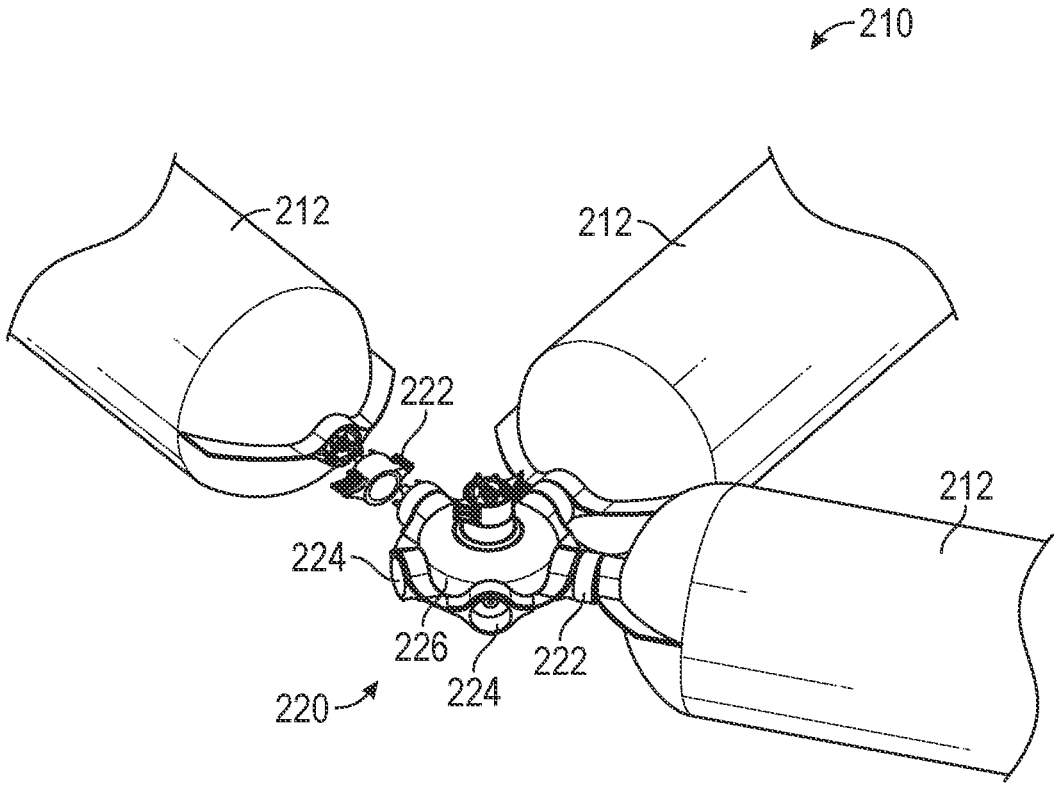

FIGS. 21 and 22 illustrate yet another embodiment of an inflatable assembly 210 having a plurality of inflatable members 212 that are coupled together via a connector 220 and a valve component 222, according to some embodiments. The connector 220 can comprise five connection ports 224 that or distributed about a perimeter of the connector body 226. The connector ports 224 can be oriented coplanar relative to each other in a body plane, but extending in different directions away from a center point of the connector body 226. Further, one or more additional connector ports can extend from the connector body 226 in a plane that is different from the body plane.

The valve component 222 can comprise a membrane or seal portion that can be deflected to an open position when protrusions of a corresponding male valve portion are pressed thereagainst. The valve component 222 can be coupled to, connected with, integrated into, or otherwise formed with the inflatable member 212 or the connector 220. The male valve portion can also be can be coupled to, connected with, integrated into, or otherwise formed with the inflatable member 212 or the connector 220. The valve component 222 can be coupled to the inflatable member 212 and/or the port 224 via a friction fit or a mechanical fit, such as a threaded connection.

Accordingly, the assembly 210 shown in FIGS. 21 and 22 illustrates that the connector can comprise one or more ports that extend in a single plane and one or more ports that extend in another plane, transverse to the plane of the other ports. As discussed above with respect to the other embodiments disclosed and illustrated herein, the connector 220 can incorporate any of a variety of features, such as valves, caps, rigid and/or soft connector arm structures, connector arms that are integrally formed or separately formed from the connector body, and the like, which will not be repeated for brevity, but are incorporated by reference herein.

Figure 23:
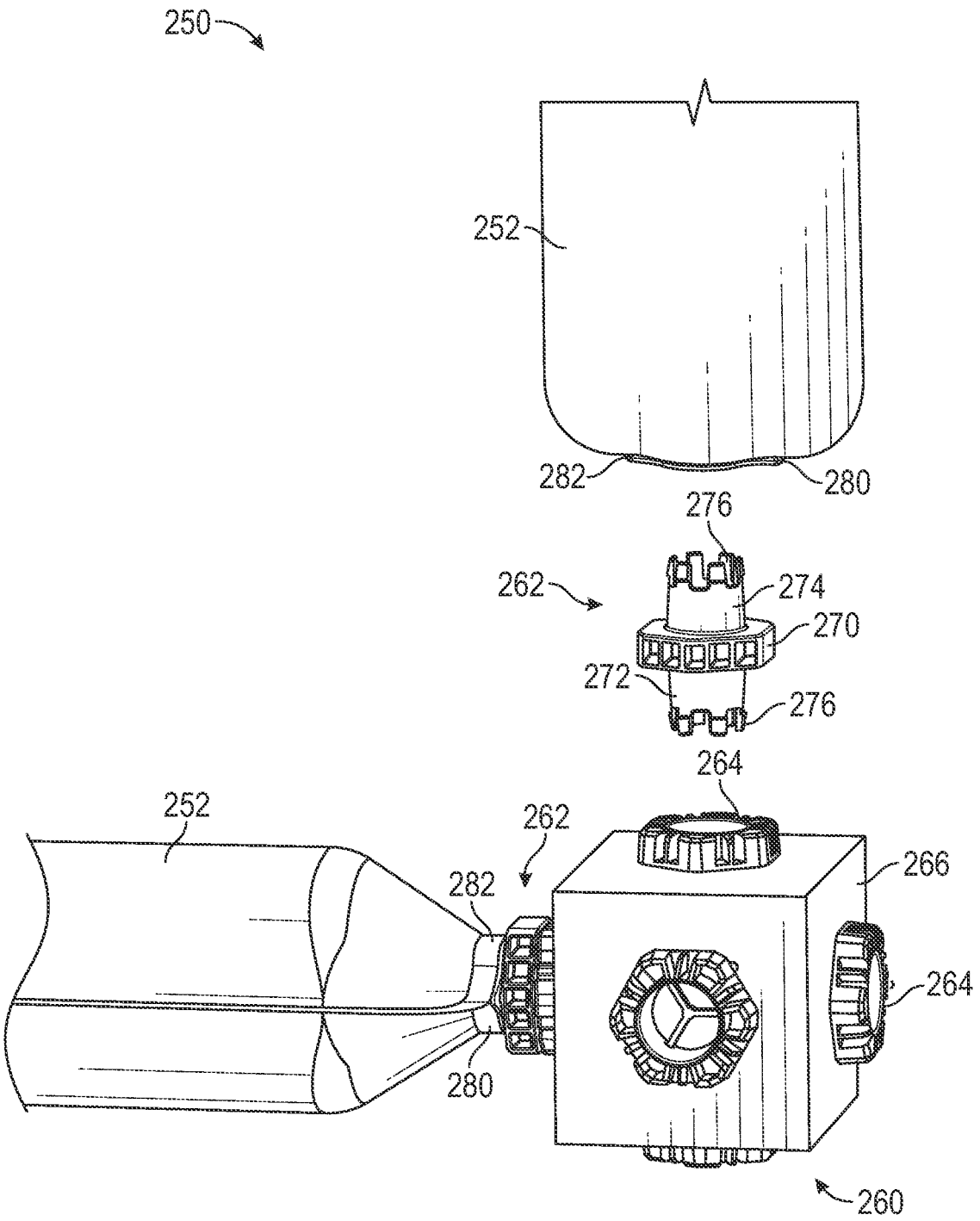
FIGS. 23 and 24 illustrate a portion of inflatable structure having inflatable members and a connector, according to some embodiments.
Figure 24:
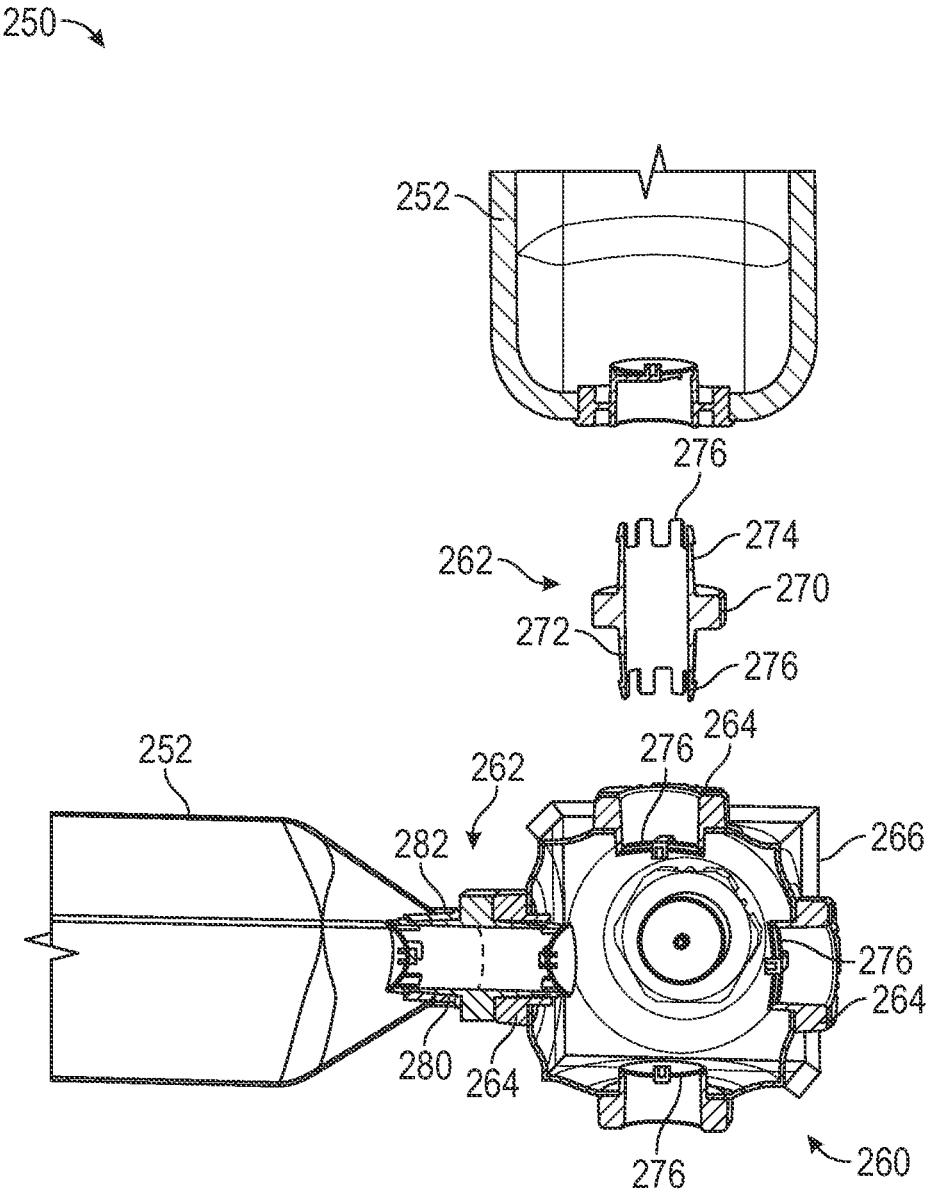

FIGS. 23 and 24 illustrate yet another embodiment of an inflatable assembly 250 having a plurality of inflatable members 252 that can be coupled together via a connector 260 and a connector arms 262, according to some embodiments. FIG. 23 shows the interconnection of a pair of inflatable members 252 with the connector 260 via the connector arms 262.

As shown in FIG. 23, the connector arms 262 can be separable from and attachable to the connector 260. The connector arms 262 can each be received within a port 264 of a body 266 of the connector 260. Each connector arm 262 can comprise a central tab area 270 that is interposed between opposing first and second end portions 272, 274 of the connector arm 262. Although the connector arm 262 is shown with diametrically opposed end portions 272, 274, the end portions could also be oriented at a 45-, 60-, or 90-degree angle, for example. Other angular orientations of the end portions relative to each other or to the central tab area 270 can also be implemented.

Further, the first and second end portions 272, 274 of the connector arm 262 can each comprise one or more engagement members 276. The engagement members 276 (e.g., deflectable prongs) can be inserted into the port 264 of the connector 260 and facilitate engagement therewith. Additionally, the engagement members 276 can be inserted into a connection socket 280 of the inflatable member(s) to facilitate engagement therewith. The first and second end portions 272, 274 can therefore be coupled to the inflatable member 252 and/or the port 264 via a friction fit (e.g., using the engagement members 276) or a mechanical fit, such as a threaded connection (not shown, but may include corresponding male and female threads on the respective first and second end portions 272, 274, the inflatable member 252, and/or the port 264.

Further, in some embodiments, the engagement members 276 can be inserted into the connection socket 280 to cause a valve 278 of the connector 260 to open. For example, the valves 278 of the connector 260 can be disposed at each of the ports 264 of the connector 260 and opened when the connector arm 262 is engaged therewith. When the connector arm 262 is removed from the connection socket 280, the valve 278 can automatically return back to its closed position.

The connection socket 280 can be at least partially recessed into the end portion of the inflatable member. Further, the connection socket 280 can comprise a rigid rim or collar 282 that can be used for facilitating grasping and engagement with the connector arm 262.

Moreover, the end portions of the inflatable members 252 can be formed as rigid or flexible. In some embodiments, the connection socket 280 can comprise a rigid material and be recessed within the end portion of the inflatable member.

FIG. 24 also shows that the connector arm 262 can be interference fitted into the port 264 of the connector 260.

As similarly discussed above with respect to other embodiments, the body 266 of the connector 260 can be flexible to permit the ports 264 thereof to bend or flex relative to each other. Further, the body 266 can comprise a pad or cushioned exterior or layer. Accordingly, if a user is contacted by a connector during use, a padded body of the connector can advantageously provide some protection against harm or trauma.

Further, in accordance with some embodiments, the connector arms 262 can advantageously be formed as rigid members. As such, the connector arms 262 can interconnect with the ports 264 of the body 266, which can be relatively flexible, pliable, in some embodiments. Moreover, if a part of the assembly 250 is broken or damaged, it may be easier and cheaper to replace only a connector arm 262 instead of the ports 264 of the body 266 or some other component that is formed integrally with the inflatable members or connector.

The features discussed individually with regard to the embodiments of FIGS. 1-24 can be implemented with other embodiments disclosed herein.

Illustration of Subject Technology as Clauses

Various examples of aspects of the disclosure are described as numbered clauses (1, 2, 3, etc.) for convenience. These are provided as examples, and do not limit the subject technology. Identifications of the figures and reference numbers are provided below merely as examples and for illustrative purposes, and the clauses are not limited by those identifications.

Clause 1. A modular inflatable structure comprising: an inflatable member comprising an inlet port and a three-dimensional form; and a connector comprising a body, a first arm, and a second arm, at least one of the first and second arms being configured to articulate with respect to the body and having a fluid passage that is fluidly interconnected with an inner volume of the body, wherein (i) in an assembled position, the inflatable member is coupled to the first arm and flow is permitted between the body and the inflatable member, and (ii) in a separated position, the inflatable member is disconnected from the first arm and flow through the first arm is blocked.

Clause 2. The inflatable structure of Clause 1, wherein the first and second arms each have a valve integrated therewith to restrict flow therethrough.

Clause 3. The inflatable structure of Clause 2, wherein in the assembled position, the inflatable member causes the valve to be open for permitting flow between the body and the inflatable member.

Clause 4. The inflatable structure of Clause 1, wherein the body comprises a flexible material for permitting deflection of the first and second arms relative to each other and to the body.

Clause 5. The inflatable structure of Clause 1, wherein the first and second arms are rigid components.

Clause 6. The inflatable structure of Clause 1, wherein the first and second arms are separable from the body.

Clause 7. The inflatable structure of Clause 1, wherein the first and second arms each comprise opposing end portions having a plurality of engagement members for coupling to the ports of the connector and to a connection socket of the inflatable member.

Clause 8. The inflatable structure of any of the preceding Clauses, further comprising a valve configured to restrict flow through the first arm, and wherein in the separated position, the valve is in a closed position to restrict flow between the body and the inflatable member.

Clause 9. The inflatable structure of Clause 8, wherein the valve is disposed within the first arm.

Clause 10. The inflatable structure of Clause 8, wherein the first arm is coupled to the body at a first end portion of the first arm, and wherein the valve is disposed at the first end of the first arm.

Clause 11. The inflatable structure of Clause 8, further comprising a second valve configured to restrict flow through the second arm, and wherein the second valve maintains a closed position to restrict flow through the second arm when the second arm is disconnected from another inflatable member, arm, or body.

Clause 12. The inflatable structure of Clause 11, wherein the second valve is disposed within the second arm.

Clause 13. The inflatable structure of Clause 11, wherein the second arm is coupled to the body at a first end portion of the second arm, and wherein the second valve is disposed at the first end of the second arm.

Clause 14. The inflatable structure of any of the preceding Clauses, wherein the first and second arms are both configured to articulate with respect to the body.

Clause 15. The inflatable structure of any of the preceding Clauses, further comprising a third arm coupled to the body.

Clause 16. The inflatable structure of Clause 15, further comprising a fourth arm coupled to the body.

Clause 17. The inflatable structure of Clause 16, further comprising a fifth arm coupled to the body.

Clause 18. The inflatable structure of Clause 17, wherein the structure comprises five inflatable members, wherein each inflatable member can be coupled to a respective one of the first, second, third, fourth, or fifth arms.

Clause 19. The inflatable structure of Clause 17, wherein the third, fourth, and fifth arms are configured to articulate with respect to the body.

Clause 20. The inflatable structure of Clause 19, wherein at least one of the first arm or the second arm is configured to rotate across an angle of at least 30 degrees with respect to the body.

Clause 21. The inflatable structure of Clause 19, wherein at least one of the first arm or the second arm is configured to rotate across an angle of at least 45 degrees with respect to the body.

Clause 22. The inflatable structure of Clause 19, wherein at least one of the first arm or the second arm is configured to rotate across an angle of at least 60 degrees with respect to the body.

Clause 23. The inflatable structure of Clause 19, wherein at least one of the first arm or the second arm is configured to rotate across an angle of at least 75 degrees with respect to the body.

Clause 24. The inflatable structure of Clause 19, wherein at least one of the first arm or the second arm is configured to rotate across an angle of at least 90 degrees with respect to the body.

Clause 25. The inflatable structure of Clause 19, wherein first end portions of the first arm, the second arm, the third arm, the fourth arm, and the fifth arm are coupled to the body at coupling points that collectively form a rotation plane, wherein articulation of the first arm, the second arm, the third arm, the fourth arm, and the fifth arm permits second end portions of the first arm, the second arm, the third arm, the fourth arm, and/or the fifth arm to be positioned on a first side or a second side of the rotation plane.

Clause 26. The inflatable structure of Clause 25, wherein the second end portions of the first arm, the second arm, the third arm, the fourth arm, and/or the fifth arm can be rotated through an angle of up to about 60 degrees on the first side of the rotation plane.

Clause 27. The inflatable structure of Clause 25, wherein the second end portions of the first arm, the second arm, the third arm, the fourth arm, and/or the fifth arm can be rotated through an angle of up to about 15 degrees on the second side of the rotation plane.

Clause 28. The inflatable structure of any of the preceding Clauses, wherein first end portions of the first arm and the second arm are coupled to the body at coupling points that collectively form a rotation plane, wherein articulation of the first arm and the second arm permits second end portions of the first arm and the second arm to be positioned on a first side or a second side of the rotation plane.

Clause 29. The inflatable structure of Clause 25, wherein the second end portions of the first arm and the second arm can be rotated through an angle of up to about 60 degrees on the first side of the rotation plane.

Clause 30. The inflatable structure of Clause 25, wherein the second end portions of the first arm and the second arm can be rotated through an angle of up to about 15 degrees on the second side of the rotation plane.

Clause 31. The inflatable structure of any of the preceding Clauses, further comprising a cap for sealing a fluid opening of the first arm.

Clause 32. The inflatable structure of any of the preceding Clauses, wherein the three-dimensional form of the inflatable member comprises first and second end portions, the inlet port being disposed at the first end portion of the three-dimensional form.

Clause 33. The inflatable structure of any of the preceding Clauses, wherein the inflatable member comprises a valve coupler at the inlet port, the valve coupler being configured to activate a valve of the first arm to permit flow between the body and the at least one inflatable member.

Clause 34. A connector for an inflatable structure, the connector comprising a body, a first arm, and a second arm, at least one of the first and second arms being configured to articulate with respect to the body and having a fluid passage that is fluidly interconnected with an inner volume of the body.

Clause 35. The connector of Clause 34, wherein the first arm has a valve integrated therewith to restrict flow therethrough.

Clause 36. The connector of Clause 35, wherein in the assembled position with an inflatable member coupled to the first arm, the valve is moved to an open state for permitting flow between the body and the inflatable member.

Clause 37. The connector of Clause 35, wherein the valve is in a default closed position to restrict flow through the first arm.

Clause 38. The connector of Clause 35, wherein the valve is disposed within the first arm.

Clause 39. The connector of Clause 35, wherein the first arm is coupled to body at a first end portion of the first arm, and wherein the valve is disposed at the first end of the first arm.

Clause 40. The connector of Clause 35, further comprising a second valve configured to restrict flow through the second arm, and wherein the second valve maintains a closed position to restrict flow through the second arm when the second arm is disconnected from another inflatable member, arm, or body.

Clause 41. The connector of Clause 40, wherein the second valve is disposed within the second arm.

Clause 42. The connector of Clause 40, wherein the second arm is coupled to the body at a first end portion of the second arm, and wherein the second valve is disposed at the first end of the second arm.

Clause 43. The connector of any of Clauses 34-42, wherein the first and second arms are both configured to articulate with respect to the body.

Clause 44. The connector of any of Clauses 34-43, further comprising a third arm coupled to the body.

Clause 45. The connector of Clause 44, further comprising a fourth arm coupled to the body.

Clause 46. The connector of Clause 45, further comprising a fifth arm coupled to the body.

Clause 47. The connector of Clause 46, wherein the third, fourth, and fifth arms are configured to articulate with respect to the body.

Clause 48. The connector of Clause 46, wherein at least one of the first arm or the second arm is configured to rotate across an angle of at least 30 degrees with respect to the body.

Clause 49. The connector of Clause 46, wherein first end portions of the first arm, the second arm, the third arm, the fourth arm, and the fifth arm are coupled to the body at coupling points that collectively form a rotation plane, wherein articulation of the first arm, the second arm, the third arm, the fourth arm, and the fifth arm permits second end portions of the first arm, the second arm, the third arm, the fourth arm, and/or the fifth arm to be positioned on a first side or a second side of the rotation plane.

Clause 50. The connector of Clause 46, wherein the second end portions of the first arm, the second arm, the third arm, the fourth arm, and/or the fifth arm can be rotated through an angle of up to about 60 degrees on the first side of the rotation plane.

Clause 51. The connector of Clause 46, wherein the second end portions of the first arm, the second arm, the third arm, the fourth arm, and/or the fifth arm can be rotated through an angle of up to about 15 degrees on the second side of the rotation plane.

Clause 52. The connector of any of Clauses 34-51, wherein at least one of the first arm or the second arm is configured to rotate across an angle of at least 45 degrees with respect to the body.

Clause 53. The connector of any of Clauses 34-52, wherein at least one of the first arm or the second arm is configured to rotate across an angle of at least 60 degrees with respect to the body.

Clause 54. The connector of any of Clauses 34-53, wherein at least one of the first arm or the second arm is configured to rotate across an angle of at least 75 degrees with respect to the body.

Clause 55. The connector of any of Clauses 34-54, wherein at least one of the first arm or the second arm is configured to rotate across an angle of at least 90 degrees with respect to the body.

Clause 56. The connector of any of Clauses 34-55, wherein first end portions of the first arm and the second arm are coupled to the body at coupling points that collectively form a rotation plane, wherein articulation of the first arm and the second arm permits second end portions of the first arm and the second arm to be positioned on a first side or a second side of the rotation plane.

Clause 57. The connector of Clause 56, wherein the second end portions of the first arm and the second arm can be rotated through an angle of up to about 60 degrees on the first side of the rotation plane.

Clause 58. The connector of Clause 56, wherein the second end portions of the first arm and the second arm can be rotated through an angle of up to about 15 degrees on the second side of the rotation plane.

Clause 59. A modular inflatable structure comprising an inflatable member comprising an inlet port, a three-dimensional form, and a connector, wherein in an assembled position, the inflatable member is coupled to a second inflatable member to permit flow between the inflatable members, the structure being configured to have an uninflated configuration and an inflated configuration in which the structure has a predefined shape.

Clause 60. A modular inflatable structure comprising a plurality of inflatable members and a connector for fluidly interconnecting the plurality of inflatable members, each inflatable member comprising a connection socket and a flexible body, the connector comprising a rigid connector arm and a flexible body configured to receive the rigid connector arm, wherein in an assembled position, the inflatable member is coupled to a second inflatable member to permit flow between the inflatable members, the structure being configured to have an uninflated configuration and an inflated configuration in which the structure has a predefined shape.

Clause 61. The inflatable structure of Clause 60, wherein the body comprises a flexible material for permitting deflection of the first and second arms relative to each other and to the body.

Clause 62. The inflatable structure of Clause 60, wherein the first and second arms are rigid components.

Clause 63. The inflatable structure of Clause 60, wherein the first and second arms are separable from the body.

Clause 64. The inflatable structure of Clause 60, wherein the first and second arms each comprise opposing end portions having a plurality of engagement members for coupling to the ports of the connector and to a connection socket of the inflatable member.

Clause 65. The inflatable structure or connector of any of the preceding Clauses, wherein the connector comprises rigid connector arms, flexible connector arms, or a mix of rigid and flexible connector arms.

Clause 66. The inflatable structure or connector of any of the preceding Clauses, wherein the connector comprises one or more connector arms that are formed integrally with the connector body.

Clause 67. The inflatable structure or connector of any of the preceding Clauses, wherein the connector comprises one or more connector arms that are formed integrally with the connector body and one or more connector arms that are coupled to the connector body via a joint.

Further Considerations

In some embodiments, any of the clauses herein may depend from any one of the independent clauses or any one of the dependent clauses. In one aspect, any of the clauses (e.g., dependent or independent clauses) may be combined with any other one or more clauses (e.g., dependent or independent clauses). In one aspect, a claim may include some or all of the words (e.g., steps, operations, means or components) recited in a clause, a sentence, a phrase or a paragraph. In one aspect, a claim may include some or all of the words recited in one or more clauses, sentences, phrases or paragraphs. In one aspect, some of the words in each of the clauses, sentences, phrases or paragraphs may be removed. In one aspect, additional words or elements may be added to a clause, a sentence, a phrase or a paragraph. In one aspect, the subject technology may be implemented without utilizing some of the components, elements, functions or operations described herein. In one aspect, the subject technology may be implemented utilizing additional components, elements, functions or operations.

The foregoing description is provided to enable a person skilled in the art to practice the various configurations described herein. While the subject technology has been particularly described with reference to the various figures and configurations, it should be understood that these are for illustration purposes only and should not be taken as limiting the scope of the subject technology.

There may be many other ways to implement the subject technology. Various functions and elements described herein may be partitioned differently from those shown without departing from the scope of the subject technology. Various modifications to these configurations will be readily apparent to those skilled in the art, and generic principles defined herein may be applied to other configurations. Thus, many changes and modifications may be made to the subject technology, by one having ordinary skill in the art, without departing from the scope of the subject technology.

It is understood that the specific order or hierarchy of steps in the processes disclosed is an illustration of exemplary approaches. Based upon design preferences, it is understood that the specific order or hierarchy of steps in the processes may be rearranged. Some of the steps may be performed simultaneously. The accompanying method claims present elements of the various steps in a sample order, and are not meant to be limited to the specific order or hierarchy presented.

As used herein, the phrase "at least one of" preceding a series of items, with the term "and" or "or" to separate any of the items, modifies the list as a whole, rather than each member of the list (i.e., each item). The phrase "at least one of" does not require selection of at least one of each item listed; rather, the phrase allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

As used herein, the term "rigid" can relate to materials that are not capable of bending or deforming from an initial shape without permanent deformation or breakage. Further, the term "flexible" can relate to materials that are capable of bending or deforming from an initial shape without permanent deformation or breakage.

Terms such as "top," "bottom," "front," "rear" and the like as used in this disclosure should be understood as referring to an arbitrary frame of reference, rather than to the ordinary gravitational frame of reference. Thus, a top surface, a bottom surface, a front surface, and a rear surface may extend upwardly, downwardly, diagonally, or horizontally in a gravitational frame of reference.

Furthermore, to the extent that the term "include," "have," or the like is used in the description or the claims, such term is intended to be inclusive in a manner similar to the term "comprise" as "comprise" is interpreted when employed as a transitional word in a claim.

As used herein, the term "about" is relative to the actual value stated, as will be appreciated by those of skill in the art, and allows for approximations, inaccuracies and limits of measurement under the relevant circumstances. In one or more aspects, the terms "about," "substantially," and "approximately" may provide an industry-accepted tolerance for their corresponding terms and/or relativity between items, such as a tolerance of from less than one percent to ten percent of the actual value stated, and other suitable tolerances.

As used herein, the term "comprising" indicates the presence of the specified integer(s), but allows for the possibility of other integers, unspecified. This term does not imply any particular proportion of the specified integers. Variations of the word "comprising," such as "comprise" and "comprises," have correspondingly similar meanings.

The word "exemplary" is used herein to mean "serving as an example, instance, or illustration." Any embodiment described herein as "exemplary" is not necessarily to be construed as preferred or advantageous over other embodiments.

A reference to an element in the singular is not intended to mean "one and only one" unless specifically stated, but rather "one or more." Pronouns in the masculine (e.g., his) include the feminine and neuter gender (e.g., her and its) and vice versa. The term "some" refers to one or more. Underlined and/or italicized headings and subheadings are used for convenience only, do not limit the subject technology, and are not referred to in connection with the interpretation of the description of the subject technology. All structural and functional equivalents to the elements of the various configurations described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description.

Although the detailed description contains many specifics, these should not be construed as limiting the scope of the subject technology but merely as illustrating different examples and aspects of the subject technology. It should be appreciated that the scope of the subject technology includes other embodiments not discussed in detail above. Various other modifications, changes and variations may be made in the arrangement, operation and details of the method and apparatus of the subject technology disclosed herein without departing from the scope of the present disclosure. In addition, it is not necessary for a device or method to address every problem that is solvable (or possess every advantage that is achievable) by different embodiments of the disclosure in order to be encompassed within the scope of the disclosure. The use herein of "can" and derivatives thereof shall be understood in the sense of "possibly" or "optionally" as opposed to an affirmative capability.

What is claimed is:

1. A modular, reconfigurable inflatable structure that is reconfigurable into one of a variety of different three-dimensional shapes while the structure is in an inflated state, the inflatable structure comprising:

a plurality of inflatable members, each inflatable member comprising an inlet port having a one-way-valve at a first end portion thereof, an inlet port having a one-way-valve at a second end portion thereof, and a three-dimensional form when inflated through either of the inlet ports;

a plurality of connector arms that each comprise engagement members, the engagement members being configured to releasably interconnect a given connector arm with a given inlet port of a given inflatable member and to open the one-way valve of the given inlet port to permit fluid communication between the given connector arm and the given inflatable member; and a connector comprising a body having a plurality of body ports, each body port comprising a one-way valve that is configured to releasably interconnect with the engagement members of the given connector arm to permit fluid communication between a given body port and the given inflatable member via the given connector arm, wherein each of the plurality of connector arms (i) is configured to move to one of a plurality of different positions with respect to the connector body for forming one of the variety of different three-dimensional shapes and (ii) has a fluid passage that is fluidly interconnected with an inner volume of the body, and wherein (i) while the structure is inflated, the given inflatable member can be moved to an assembled position in which the given inflatable member is coupled to the given connector arm and flow is permitted between the body and the given inflatable member at the given body port, and (ii) while the structure is inflated, the given inflatable member can be moved to a separated position in which the given inflatable member is disconnected from the given body port and flow through the given body port is blocked.

2. The inflatable structure of claim 1, wherein the body comprises a flexible material for permitting deflection of the plurality of connector arms relative to each other and to the body.

3. The inflatable structure of claim 1, wherein all of the plurality of connector arms are rigid components.

4. The inflatable structure of claim 1, wherein all of the plurality of connector arms are separable from the body.

5. The inflatable structure of claim 1, wherein all of the plurality of connector arms (i) are separable from the body and (ii) each comprise a tubular shape with opposing end portions having a plurality of engagement members for coupling to a plurality of ports of the connector and to a connection socket of the inflatable member.

6. The inflatable structure of claim 1, wherein all of the plurality of connector arms are configured to move with respect to the body.

7. The inflatable structure of claim 1, wherein the plurality of connector arms comprises three connector arms that can be coupled to the body.

8. The inflatable structure of claim 7, wherein the plurality of connector arms comprises four connector arms that can be coupled to the body.

9. The inflatable structure of claim 8, wherein the plurality of connector arms comprises five connector arms that can be coupled to the body.

10. The inflatable structure of claim 9, wherein the structure comprises five inflatable members, wherein each inflatable member can be coupled to a respective one of the five connector arms.

11. The inflatable structure of claim 1, wherein first end portions of a first arm and a second arm of the plurality of connector arms are coupled to the body at coupling points that collectively form a rotation plane, wherein movement of the first arm and the second arm permits second end portions of the first arm and the second arm to be positioned on a first side or a second side of the rotation plane.

12. The inflatable structure of claim 1, wherein first and second arms of the plurality of connector arms each comprise a lumen having a central axis, wherein the central axes of the first and second arms are movable relative to the body.

13. The inflatable structure of claim 11, wherein the body comprises one or more sockets that each have an opening, wherein a perimeter of the opening forms an opening plane that is oriented transverse relative to a horizontal plane.

14. The inflatable structure of claim 1, wherein the connector is removably coupled to the inlet port and movable relative to the inlet port.

15. The inflatable structure of claim 1, wherein each of the plurality of different positions is a fixed position of the at least one of the plurality of connector arms relative to the body.

16. The inflatable structure of claim 1, wherein the engagement members of the given connector arm comprise a smooth tubular section.

17. The inflatable structure of claim 1, wherein each of the plurality of connector arms is configured to be selectively moved to one of the plurality of ports of the connector body in order to be moved to one of the plurality of positions for forming one of the variety of different three-dimensional shapes.

18. The inflatable structure of claim 1, wherein in the separated position, the given connector arm is also disconnected from the given body port and flow through the given body port is blocked.

19. The inflatable structure of claim 1, wherein the given inflatable member can be coupled to another inflatable member.

20. The inflatable structure of claim 1, wherein the given inflatable member can be coupled to another inflatable member via a connector arm.

21. The inflatable structure of claim 1, wherein the given inflatable member comprises a one-way valve at the given inlet port, and wherein when the given connector arm is removed from the given inlet port of the given inflatable member, the given one-way valve automatically returns to a closed position.

22. A modular, reconfigurable inflatable structure that is reconfigurable into one of a variety of different three-dimensional shapes while the structure is in an inflated state, the inflatable structure comprising:

a plurality of inflatable members, each inflatable member comprising an inlet port having a valve at a first end portion thereof, an inlet port having a valve at a second end portion thereof, and a three-dimensional form when inflated through either of the inlet ports;

a plurality of connector arms that each comprise engagement members, the engagement members being configured to releasably interconnect a given connector arm with a given inlet port of a given inflatable member and to open the valve of the given inlet port to permit fluid communication between the given connector arm and the given inflatable member; and a connector comprising a body having a plurality of body ports, each body port comprising a valve that is configured to releasably interconnect with the engagement members of the given connector arm to permit fluid communication between a given body port and the given inflatable member via the given connector arm, wherein each of the plurality of connector arms (i) is configured to be coupled to the connector body and move to one of a plurality of different positions with respect to the connector body for forming one of the variety of different three-dimensional shapes and (ii) has a fluid passage that is fluidly interconnected with an inner volume of the body, and wherein (i) while the structure is inflated, the given inflatable member can be moved to an assembled position in which the given inflatable member and the given connector arm are coupled to the given body port and flow is permitted between the body and the given inflatable member at the given body port, and (ii) while the structure is inflated, the given inflatable member can be moved to a separated position in which the given inflatable member is disconnected from the given body port and flow through the given body port is blocked.

23. The inflatable structure of claim 22, wherein the engagement members of the given connector arm comprise a smooth tubular section.

24. The inflatable structure of claim 22, wherein each of the plurality of connector arms is configured to be selectively moved to one of the plurality of ports of the connector body in order to be moved to one of the plurality of positions for forming one of the variety of different three-dimensional shapes.

25. The inflatable structure of claim 22, wherein in the separated position, the given connector arm is also disconnected from the given body port and flow through the given body port is blocked.

26. The inflatable structure of claim 22, wherein the given inflatable member can be coupled to another inflatable member.

27. The inflatable structure of claim 22, wherein the given inflatable member can be coupled to another inflatable member via a connector arm.

28. The inflatable structure of claim 22, wherein the given inflatable member comprises a one-way valve at the given inlet port, and wherein when the given connector arm is removed from the given inlet port of the given inflatable member, the one-way valve automatically returns to a closed position.

* * * * *